US012162656B1

(12) United States Patent
Pischel et al.

(10) Patent No.: US 12,162,656 B1
(45) Date of Patent: Dec. 10, 2024

(54) SHOE HANGER BOX

(71) Applicant: Atlantic Corporation of Wilmington, Inc., Charlotte, NC (US)

(72) Inventors: Kyle Pischel, Charlotte, NC (US); Sebastian Tine, Charlotte, NC (US)

(73) Assignee: ATLANTIC CORPORATION OF WILMINGTON, INC., Charlotte, NC (US)

( * ) Notice: Subject to any disclaimer, the term of this patent is extended or adjusted under 35 U.S.C. 154(b) by 37 days.

(21) Appl. No.: 18/203,101

(22) Filed: May 30, 2023

(51) Int. Cl.

| | |
|---|---|
| ***B65D 85/18*** | (2006.01) |
| ***B65D 5/20*** | (2006.01) |
| ***B65D 5/54*** | (2006.01) |
| ***B65D 73/00*** | (2006.01) |

(52) U.S. Cl.
CPC ..... *B65D 5/5475* (2013.01); *B65D 5/2052* (2013.01); *B65D 73/0021* (2013.01); *B65D 85/187* (2013.01)

(58) Field of Classification Search
CPC ..... B65D 5/5475; B65D 5/2052; B65D 73/0021; B65D 85/187
USPC ..... 206/745, 756, 750, 765, 764
See application file for complete search history.

(56) References Cited

U.S. PATENT DOCUMENTS

| | | | | |
|---|---|---|---|---|
| 3,570,665 | A | 3/1971 | Houston et al. | |
| 5,193,671 | A | 3/1993 | Patterson | |
| 5,269,408 | A | 12/1993 | Otis et al. | |
| 5,752,597 | A | 5/1998 | Brangle, Jr. | |
| 2005/0082179 | A1* | 4/2005 | Terwelp | B65D 5/46024 206/278 |
| 2011/0094907 | A1* | 4/2011 | Meynard | B65D 5/48024 229/120.08 |
| 2016/0145035 | A1* | 5/2016 | Bates | B65D 21/086 206/292 |
| 2017/0275048 | A1* | 9/2017 | Brogna | B65D 5/248 |
| 2021/0316939 | A1* | 10/2021 | Cepeda | B65D 85/187 |
| 2022/0227571 | A1* | 7/2022 | French, Sr. | B65D 37/00 |
| 2023/0040344 | A1* | 2/2023 | Cotte | B65D 79/02 |

FOREIGN PATENT DOCUMENTS

FR 2847238 A1 5/2004

* cited by examiner

*Primary Examiner* — Jacob K Ackun
(74) *Attorney, Agent, or Firm* — Barnes & Thornburg LLP

(57) ABSTRACT

A convertible package includes a shipping mode blank configured to be folded to form a product-shipping container. The product-shipping container includes a shipping-container body formed to define a product-receiving shipping space and a lid. The lid is pivotably coupled to the shipping-container body about a lid axis to change between a closed position and an open position.

20 Claims, 16 Drawing Sheets

SHOE HANGER BOX

BACKGROUND

The present disclosure relates to product containers, and particularly to product containers made of a paper material. More particularly, the present disclosure relates to a product container formed folded from a product blank.

SUMMARY

A method may include providing a shipping mode blank. The shipping mode blank may include a center portion and a discardable portion configured to be separated from the center portion.

In some embodiments, the method may further include folding the shipping-mode blank to produce a product-shipping container. The product-shipping container may include a shipping-container body and a lid. The shipping-container body may be formed to define a product-receiving shipping space. The lid may be pivotably coupled to the shipping-container body about a lid axis to change between a closed position in which the lid covers a top opening of the shipping-container body to block access to the product-receiving shipping space and an opened position in which the lid is spaced apart from the top opening.

In some embodiments, the method further includes unfolding the shipping-mode blank. The method may further include separating the discardable portion of the shipping-mode blank from the center portion along a perforated line to produce a display-mode blank.

In some embodiments, the method may further include folding the display-mode blank to produce a product-display container. The product-display container may include a display-container body and a strap. The display-container body may be formed to define a product-receiving display space. The strap may be coupled to the display-container body. The strap may be configured to extend around a product located in the product-receiving display space to retain the product in the product-receiving display space.

In some embodiments, the shipping mode blank may include a bottom panel, left, right, front, and rear container walls, a lid panel, and left, right, and front lid walls. Each of the left, right, front, and rear container walls may be coupled to the bottom panel along a respective fold line. The lid panel may be coupled to the rear container wall along a lid fold line. Each of the left, right, and front lid walls may be coupled to the lip panel along a respective fold line.

In some embodiments, the method may further include folding the shipping-mode blank to produce the product-shipping container. The step of folding the shipping-mode blank may include folding the left, right, front, and rear container walls along the respective fold lines relative to the bottom panel to form the shipping-container body of the product-shipping container. The step of folding the shipping-mode blank may further include folding the left, right, and front lid walls along the respective fold lines relative to the lid panel to form the lid of the product-shipping container. The step of folding the shipping-mode blank to produce the product-shipping container may further include folding the lid panel along the lid fold line.

In some embodiments, the display-mode blank may further include the bottom panel, the left container wall, a portion of the right, front, and rear container walls, a portion of the lid panel, and a portion of the front lid wall.

In some embodiments, the step of folding the display-mode blank to produce the product-display container may include folding the left container wall and the portions of the front and rear container walls along the respective fold lines relative to the bottom panel to form the display-container body of the product-display container. The step of folding the display-mode blank to produce the product-display container may further include folding the portion of the rear container wall, the portion of the lid panel, and the portion of the front lid wall along the respective fold lines relative to the bottom panel to from the strap of the product-display container.

In some embodiments, the bottom panel, the left container wall, a portion of the right, front, and rear container walls may form the display-container body of the product-display container. In some embodiments, a portion of the rear container wall, a portion of the lid panel, and a portion of the front lid wall may form the strap of the product-display container.

In some embodiments, the method may further include hanging the product-display container on a display hook. The product-display container may be hung on the display hook after folding the display-mode blank to produce the product-display container.

In some embodiments, the product-display container may further include a hanger. The hanger may be coupled to the display-container body. The hanger may be configured to support the product-display container on the display hook. In some embodiments, the portion of the right container wall may form the hanger of the product-display container.

In some embodiments, the shipping-mode blank may include a bottom panel and left, right, front, and rear container walls each coupled to the bottom panel along a respective fold line. The shipping-mode blank may further include a lid panel coupled to the rear container wall along a lid fold line and left, right, and front lid walls each coupled to the lip panel along a respective fold line. In some embodiments, the display-mode blank may include the bottom panel, the left container wall, a portion of the right container wall, a portion of the front container wall, a portion of the rear container wall, a portion of the lid panel, and a portion of the front lid wall.

In some embodiments, the step of folding the shipping-mode blank to produce the product-shipping container may include folding the left, right, front, and rear container walls along the respective fold lines relative to the bottom panel to form the shipping-container body of the product-shipping container. The step of folding the shipping-mode blank to product the product-shipping container may further include folding the left, right, and front lid walls along the respective fold lines relative to the lid panel to form the lid of the product-shipping container. In some embodiments, the step of folding the shipping-mode blank may further include folding the shipping-mode blank to produce the product-shipping container further includes folding the lid panel along the lid fold line.

In some embodiments, the step of folding the display-mode blank to produce the product-display container may include folding the left container wall and the portions of the front and rear container walls along the respective fold lines relative to the bottom panel to form the display-container body of the product-display container. The step of folding the display-mode blank to product the product-display container may further include folding the portion of the rear container wall, the portion of the lid panel, and the portion of the front lid wall along the respective fold lines relative to the bottom panel to from the strap of the product-display container.

In some embodiments, the method may further include hanging the product-display container on a display hook. The product-display container may be hung on the display hook after folding the display-mode blank to produce the product-display container.

In some embodiments, the product-display container may further include a hanger coupled to the display-container body. The step of hanging the product-display container on the display hook may include engaging the hanger of the product-display container with the display hook.

According to another aspect of the present disclosure, a convertible package may include a shipping mode blank. The shipping mode blank may be configured to be folded to form a product-shipping container. The product-shipping container may include a shipping-container body and a lid. The shipping-container body may be formed to define a product-receiving shipping space. The lid may be pivotably coupled to the shipping-container body about a lid axis to change between a closed position in which the lid covers a top opening of the shipping-container body to block access to the product-receiving shipping space and an opened position in which the lid is spaced apart from the top opening.

In some embodiments, the shipping mode blank may include a center portion and a discardable portion. The discardable portion may be configured to be separated from the center portion to produce a display-mode blank. The display-mode blank may be configured to folded to form a product-display container. The product-display container may include a display-container body and a strap. The display-container body may be formed to define a product-receiving display space. The strap may be coupled to the display-container body. The strap may be configured to extend around a product located in the product-receiving display space to retain the product in the product-receiving display space.

In some embodiments, the shipping mode blank may include a bottom panel, left, right, front, and rear container walls each coupled to the bottom panel along a respective fold line, a lid panel coupled to the rear container wall along a lid fold line, and left, right, and front lid walls each coupled to the lip panel along a respective fold line. The bottom panel and the left, right, front, and rear container walls may be configured to be folded to form the shipping-container body of the product-shipping container. The lid panel and the left, right, and front lid walls may be configured to be folded to form the lid of the product-shipping container.

In some embodiments, the display-mode blank may include the bottom panel, the left container wall, a portion of the right, front, and rear container walls, a portion of the lid panel, and a portion of the front lid wall. The bottom panel, the left container wall, and the portions of the front and rear shipping-container may be configured to be folded to form the display-container body of the product-display container. The portion of the rear container wall, the portion of the lid panel, and the portion of the front lid wall may be configured to be folded to from the strap of the product-display container.

In some embodiments, the product-display container may further include a hanger. The hanger may be coupled to the display-container body. The hanger may be configured to support the product-display container on a display hook Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is diagrammatic perspective view of a shipping-mode blank as shown in FIG. 3 that has been folded into a product-shipping container including a shipping-container body formed to define a product-receiving space and a lid pivotably coupled to the shipping-container body about a lid axis to change between a closed position as shown in FIG. 16 to block access to the product in the product-receiving space and an opened position as shown in FIG. 15 to allow access to the product in the product-receiving space;

FIG. 2 is a diagrammatic perspective view of a display-mode blank taken from the shipping-mode blank as shown in FIG. 3 that has been folded into a product-display container including a display-container body formed to define a product-receiving display space and a strap coupled to the display-container body configured to extend around a product located in the product-receiving display space to retain the product in the product-receiving display space;

FIG. 3 is an elevation view of the shipping-mode blank showing the shipping-mode blank is formed to include a discardable portion and a center portion, and the discardable portion gets removed from the center portion to produce the display-mode blank so that the display-mode blank may be folded into the product-display container of FIG. 2, and further showing the shipping-mode blank includes a bottom panel with left, right, front, and rear container walls that get folded along corresponding fold lines to form the shipping-container body of the product-shipping container and a lid panel with left, right, and front lid walls that get folded along corresponding fold lines to form the lid of the product-shipping container FIG. 4 is a diagrammatic view of a process of assembling the product-shipping container and the product-display container using the shipping mode blank showing the process includes folding the original shipping-mode blank to product the product-shipping container, unfolding the shipping-mode blank, and converting the unfolded shipping-mode blank to a product-display container by separating the discardable portion of the shipping-mode blank to provide the display-mode blank and then folding the display-mode blank to produce the product-display container;

Figure 3:
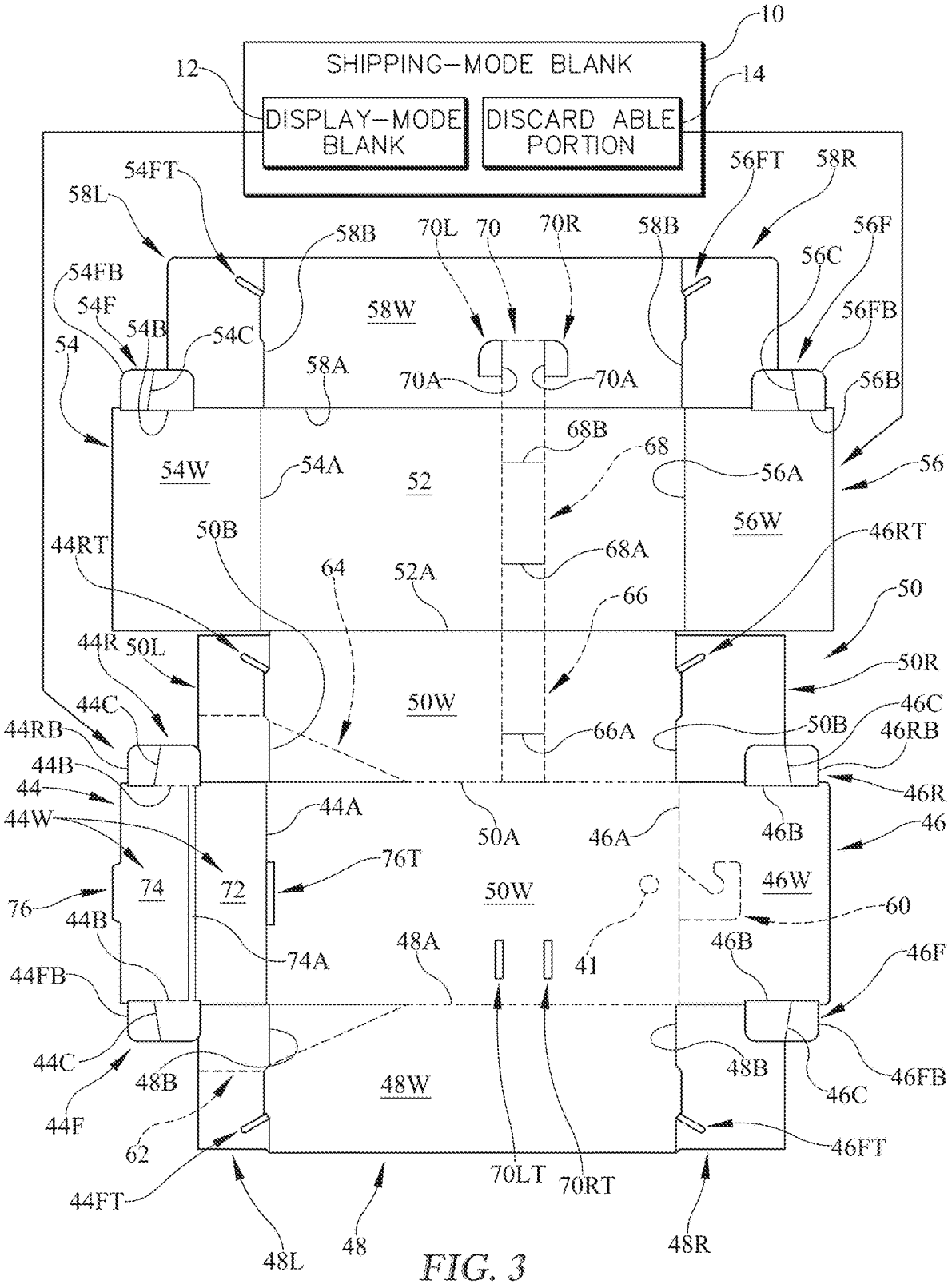
Figure 8:
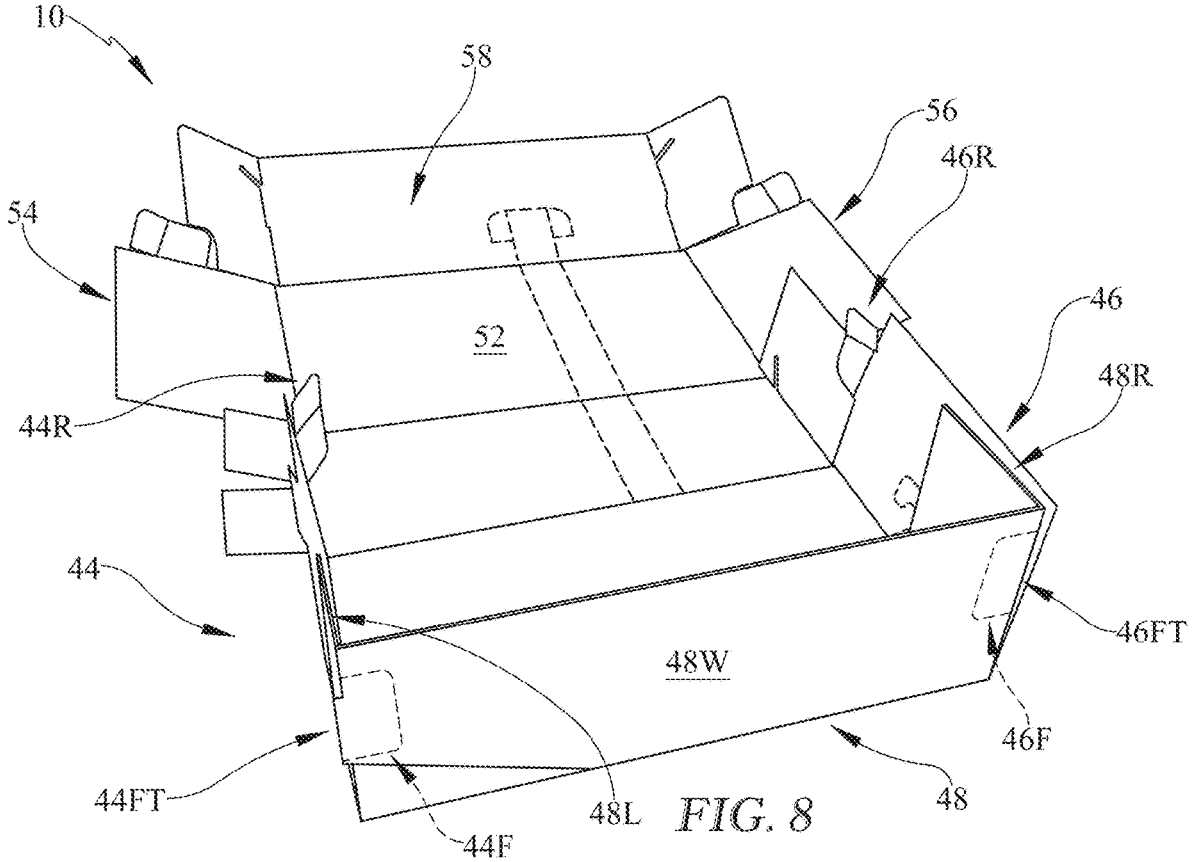
FIG. 8 is a view similar to FIG. 7 showing the container anchor tabs on each of the left and right container walls has been inserted into respective tab receivers on the left and right front anchor flaps to hold the front, left, and right container walls an upright position relative to the bottom panel.
Figure 9:
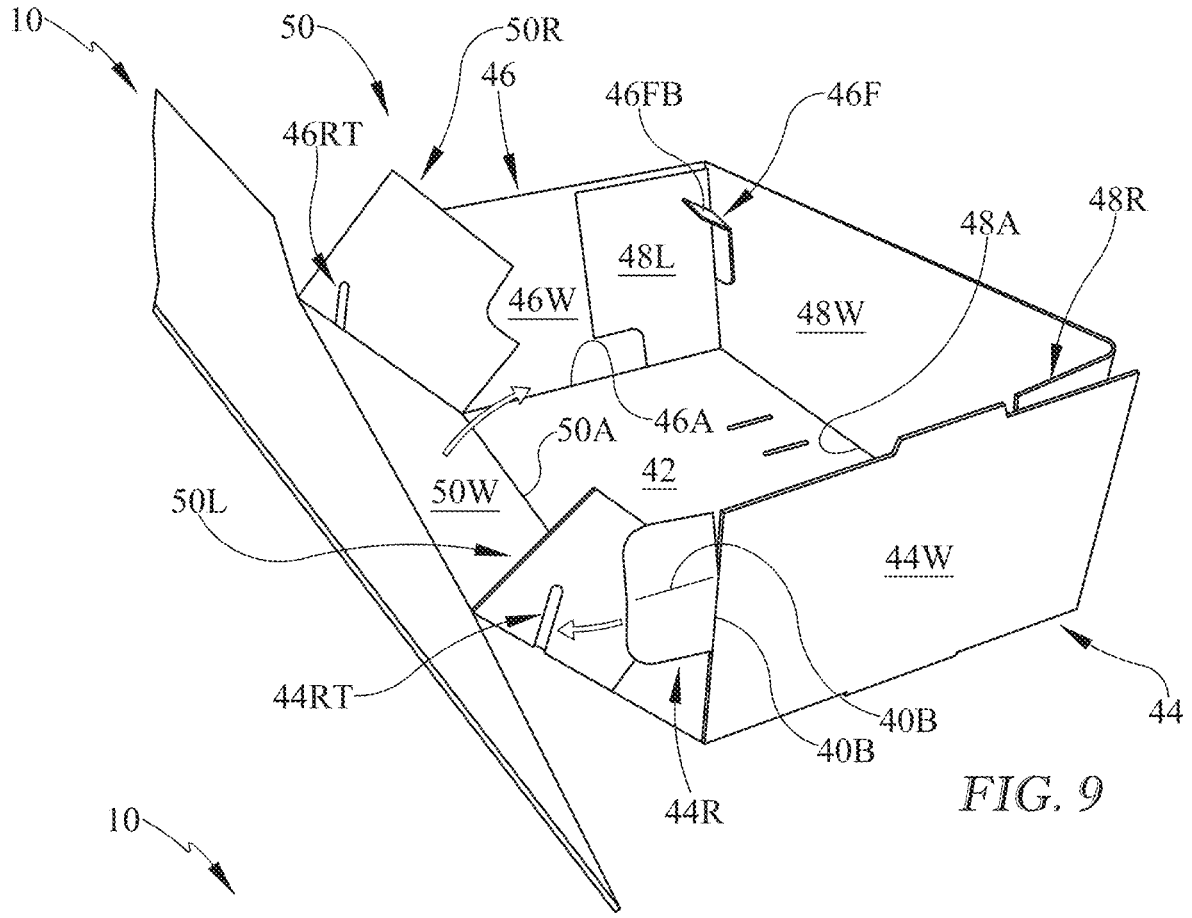
Figure 10:
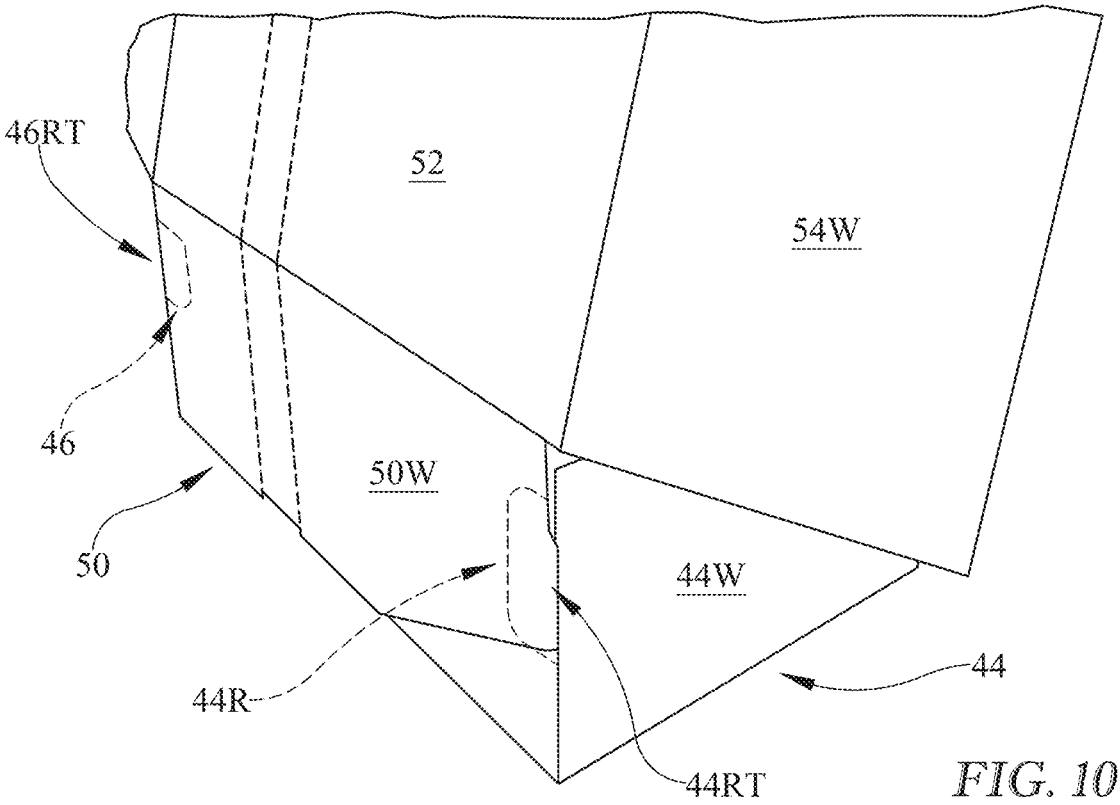
Figure 11:
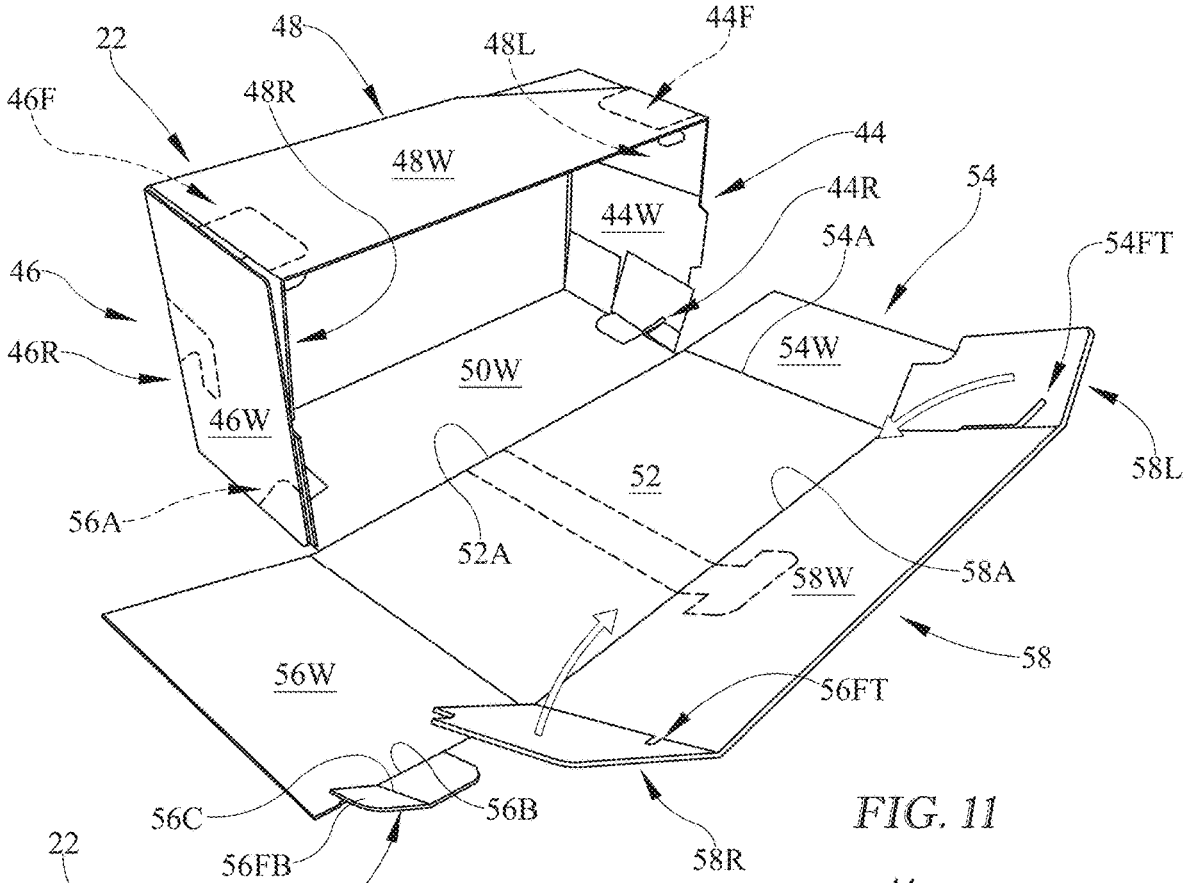
Figure 12:
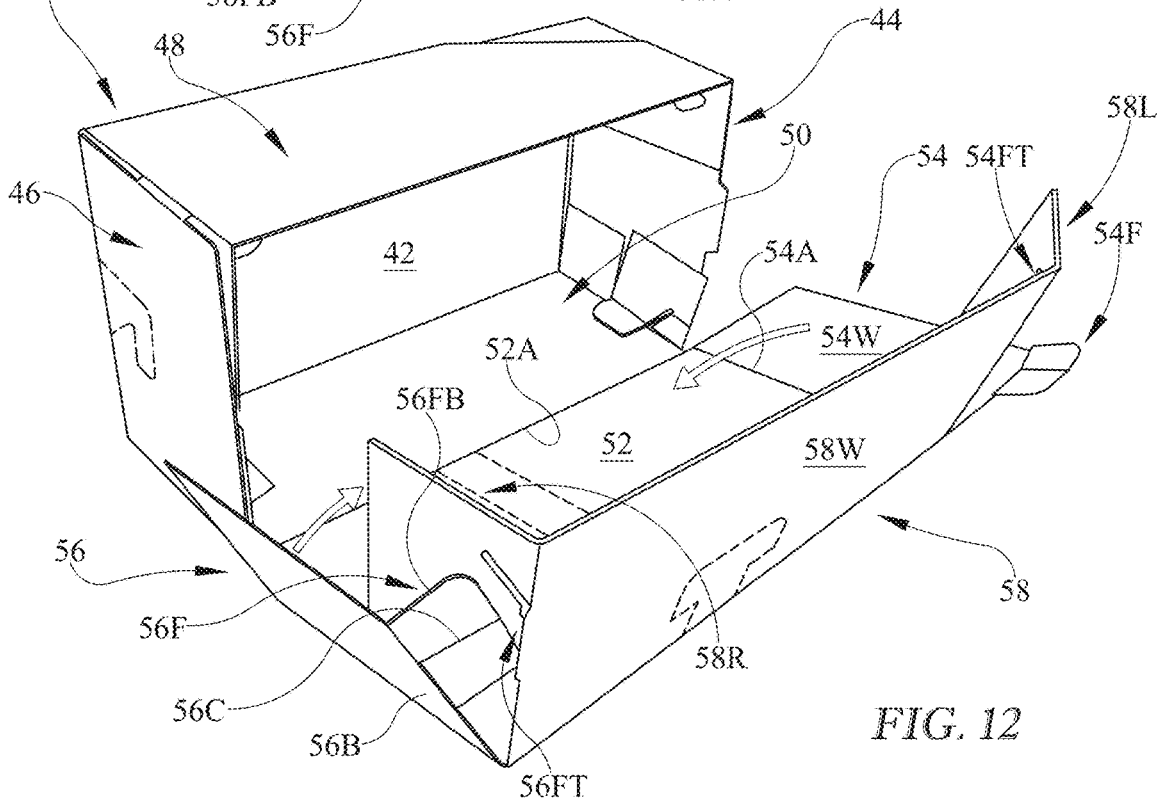
Figure 13:
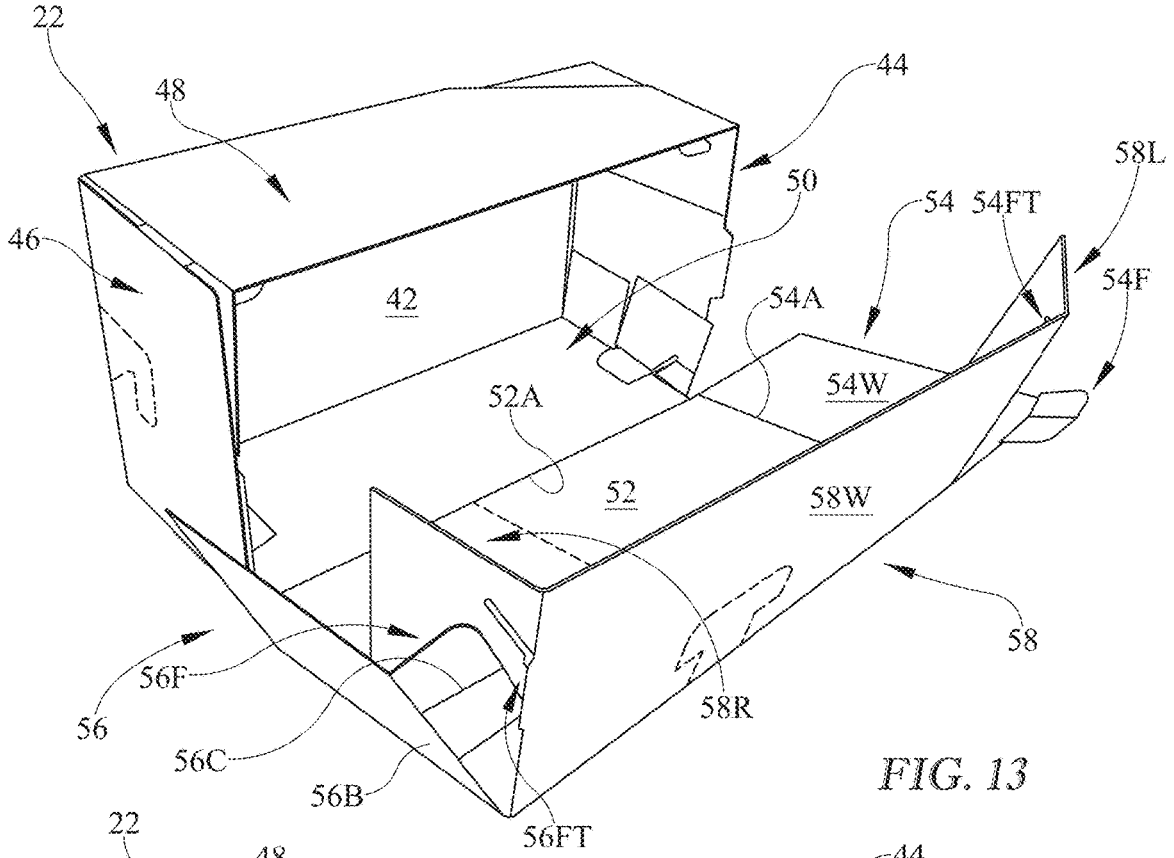
Figure 14:
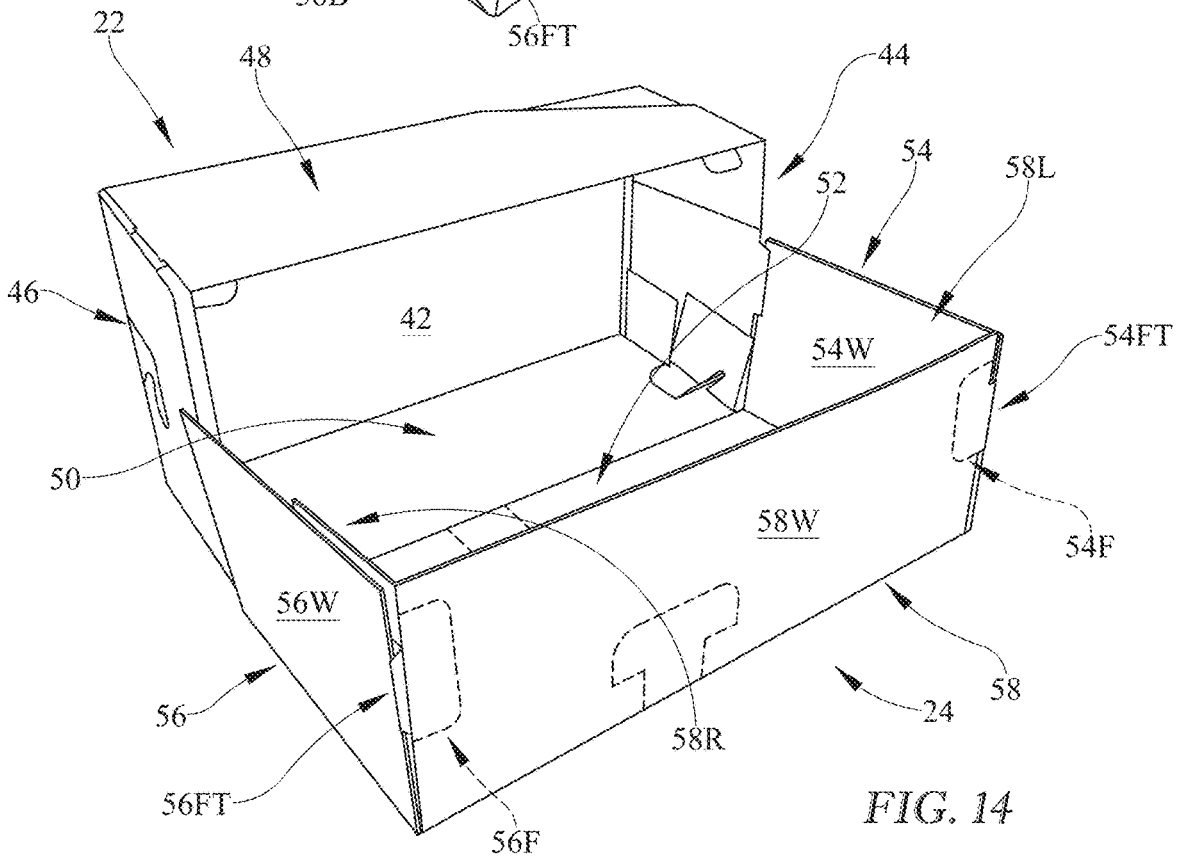
Figure 15:
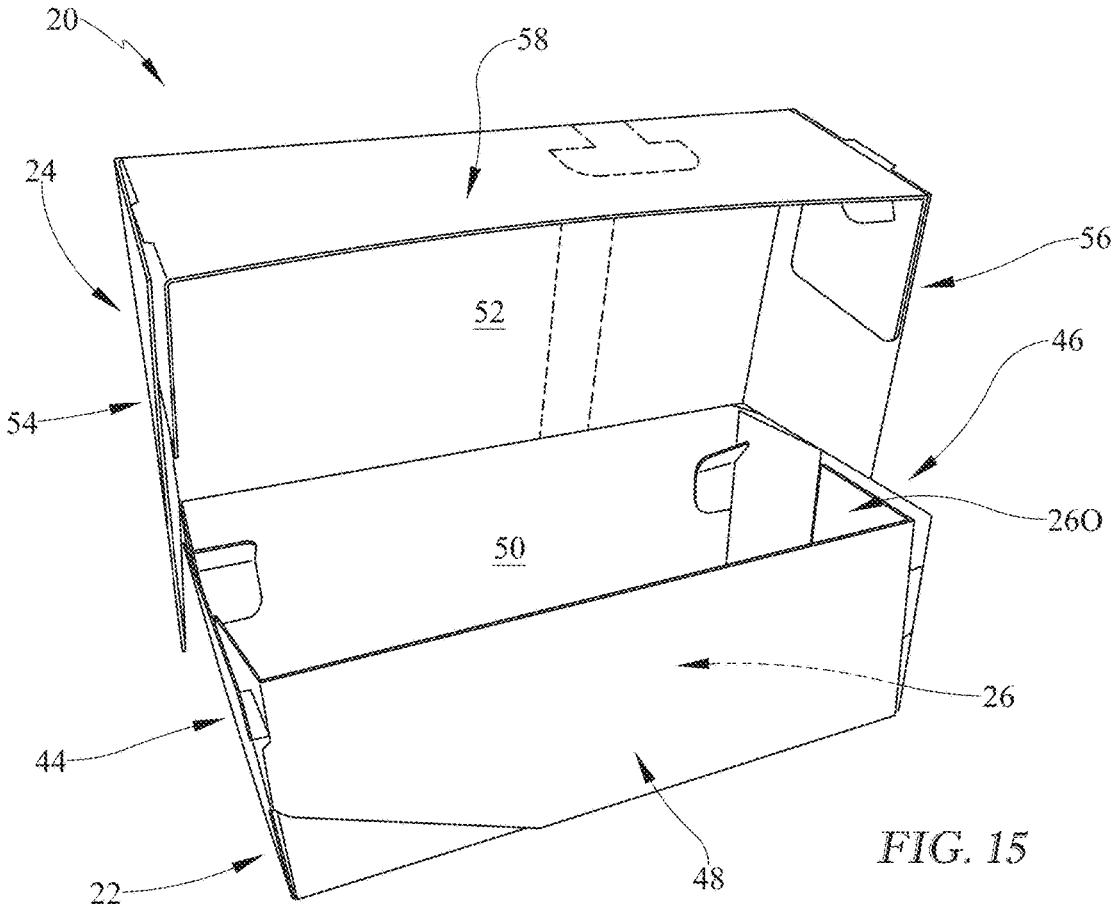
Figure 16:
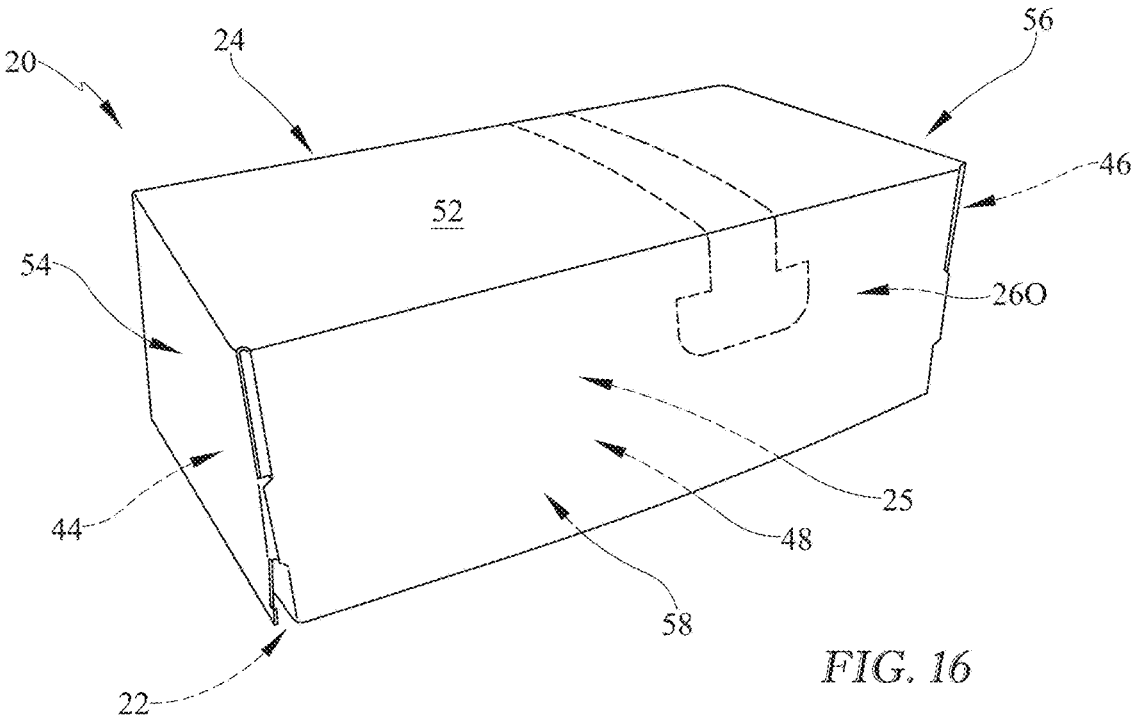
Figure 17:
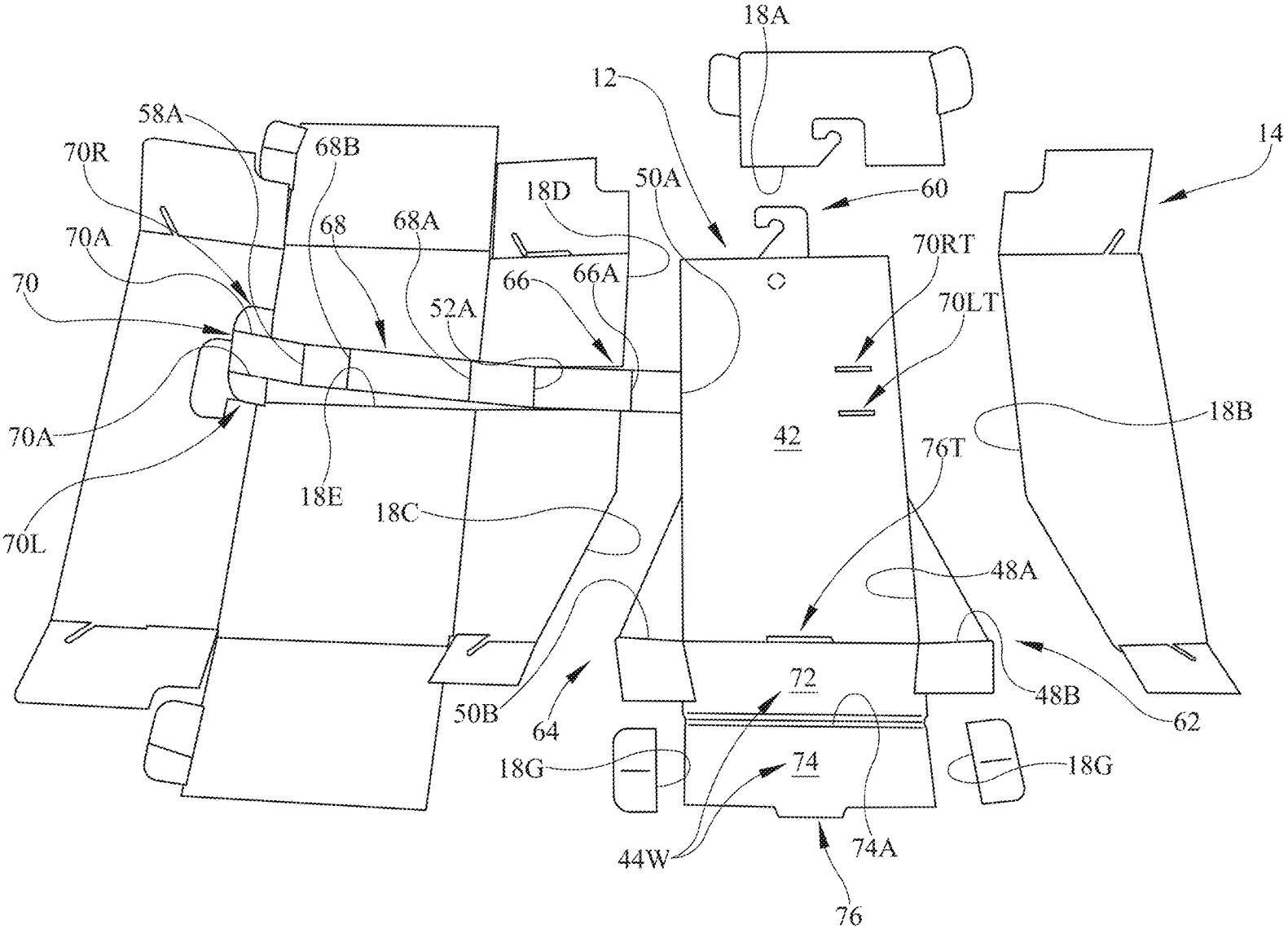
Figure 18:
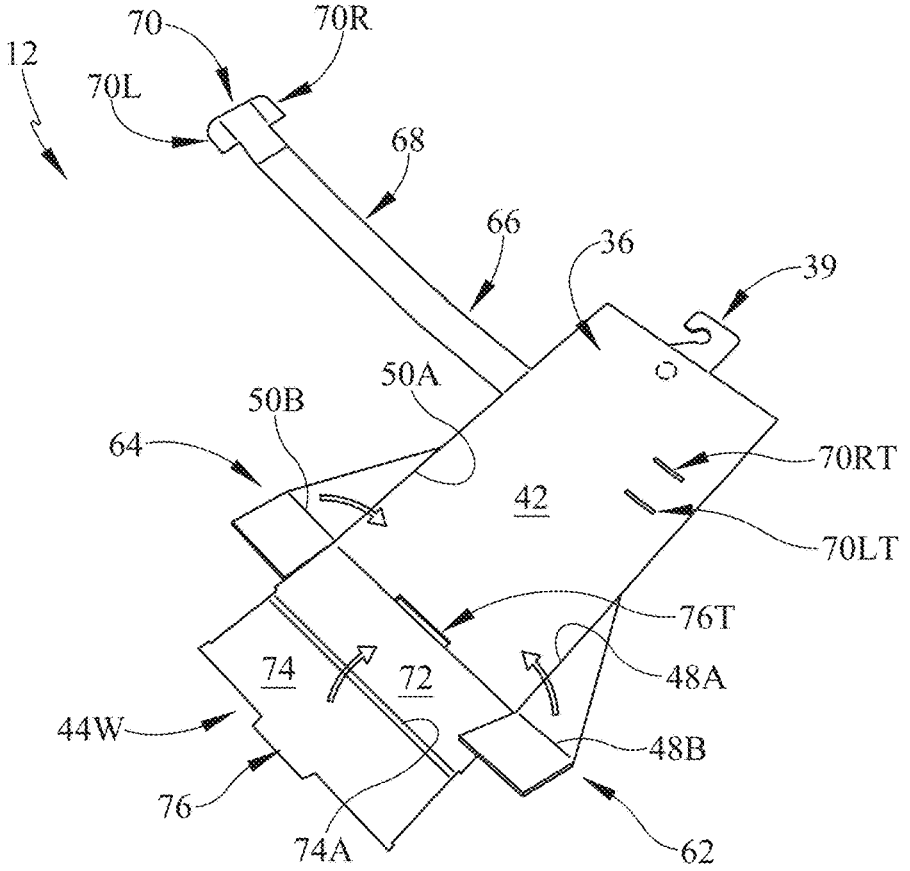
Figure 19:
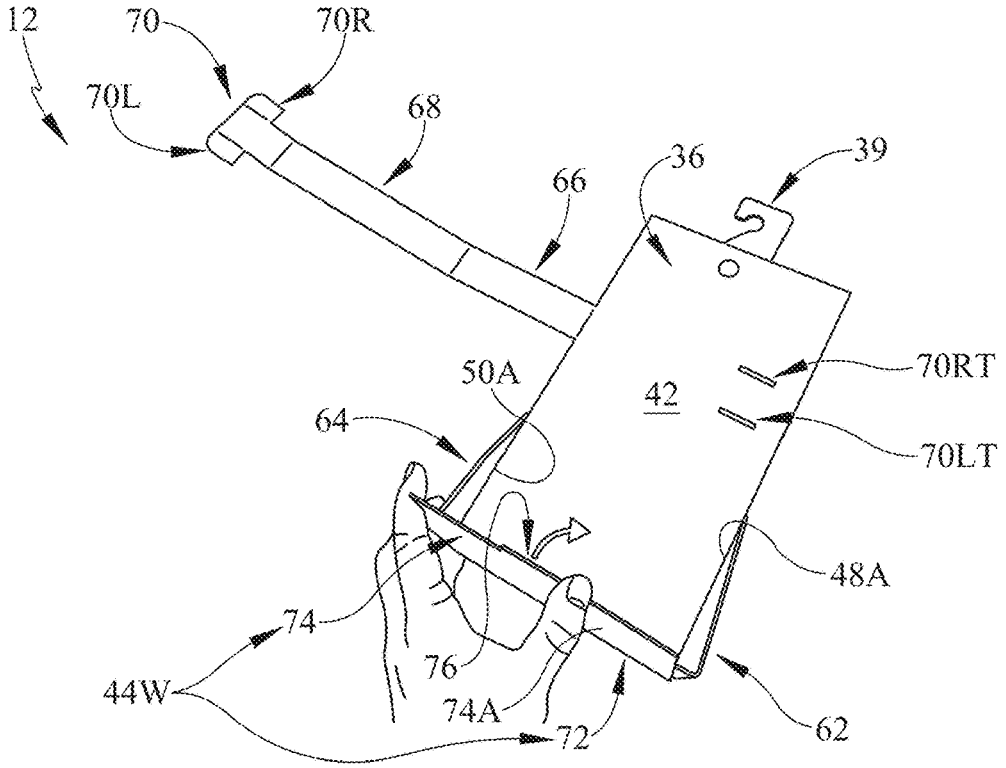
Figure 20:
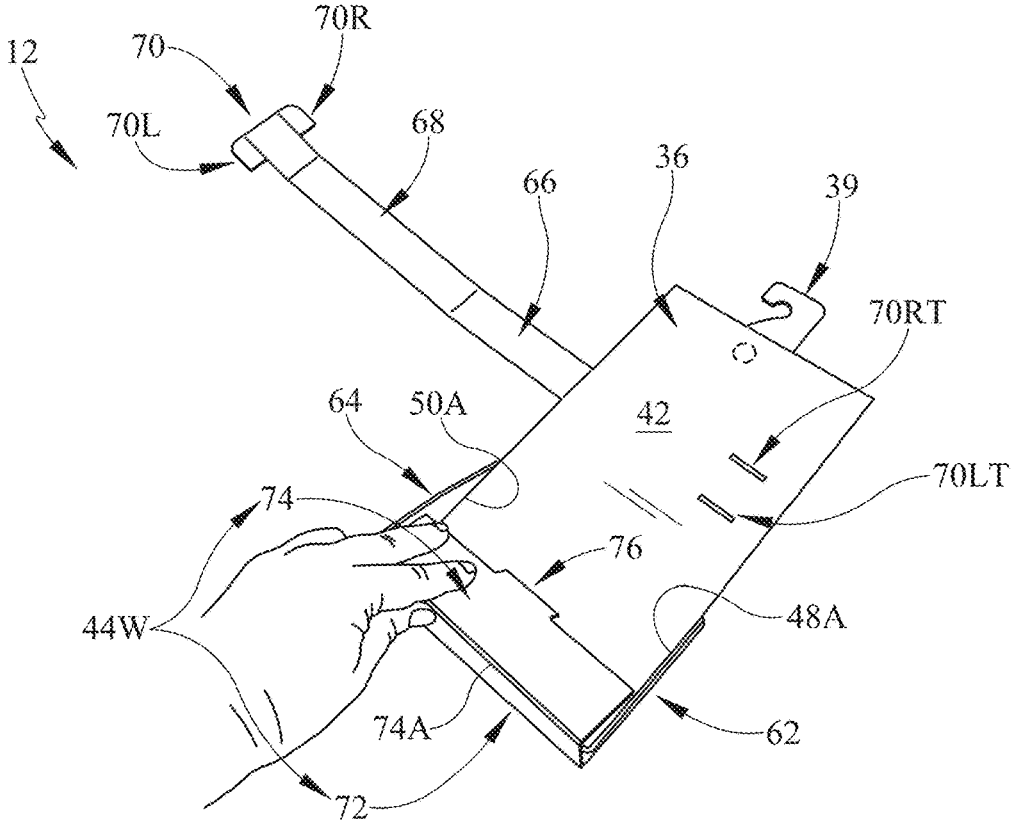
Figure 21:
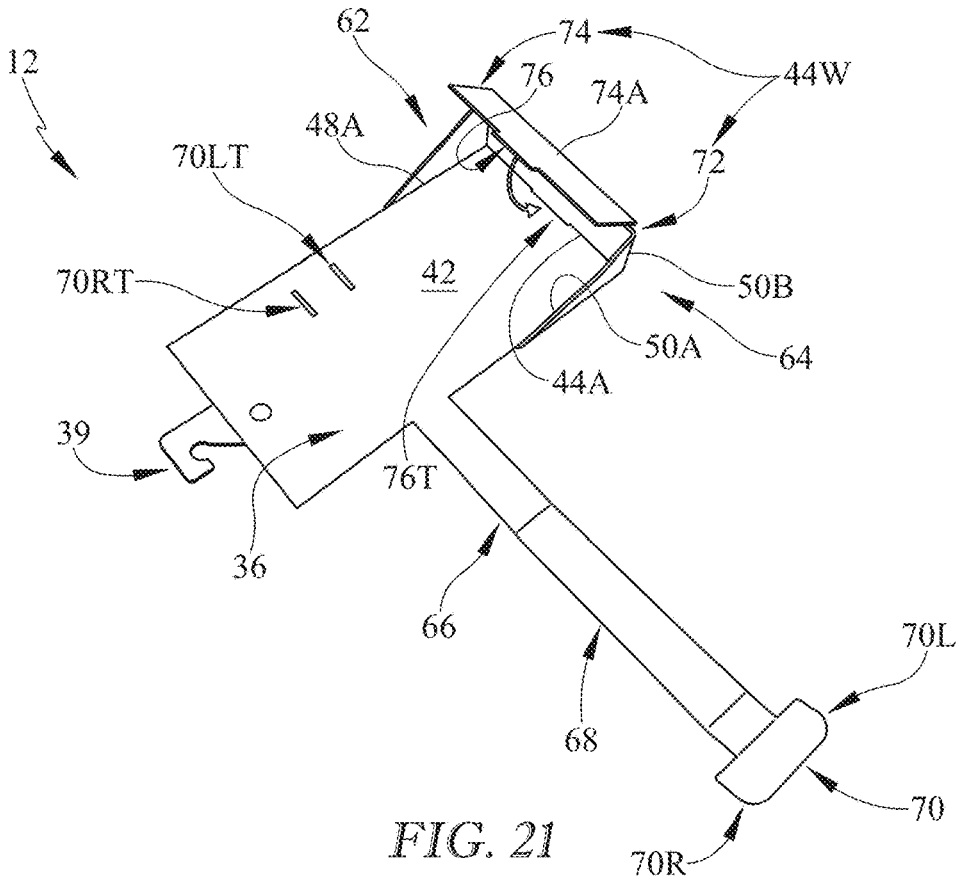
Figure 22:
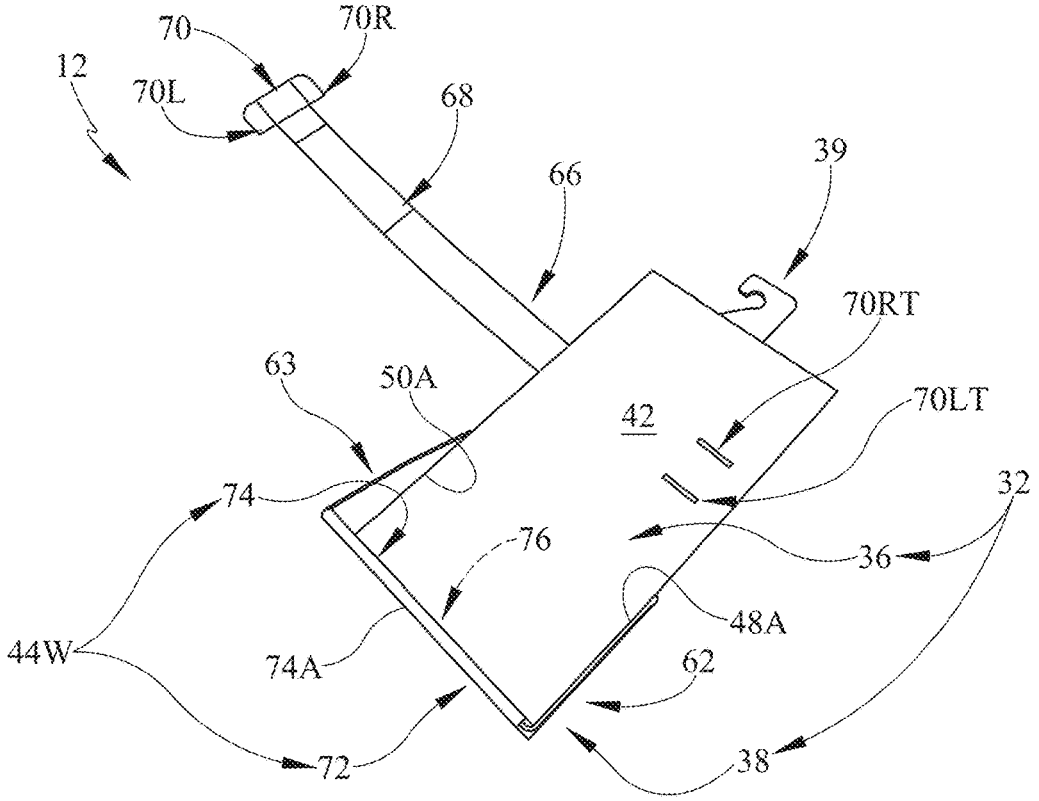
Figure 23:
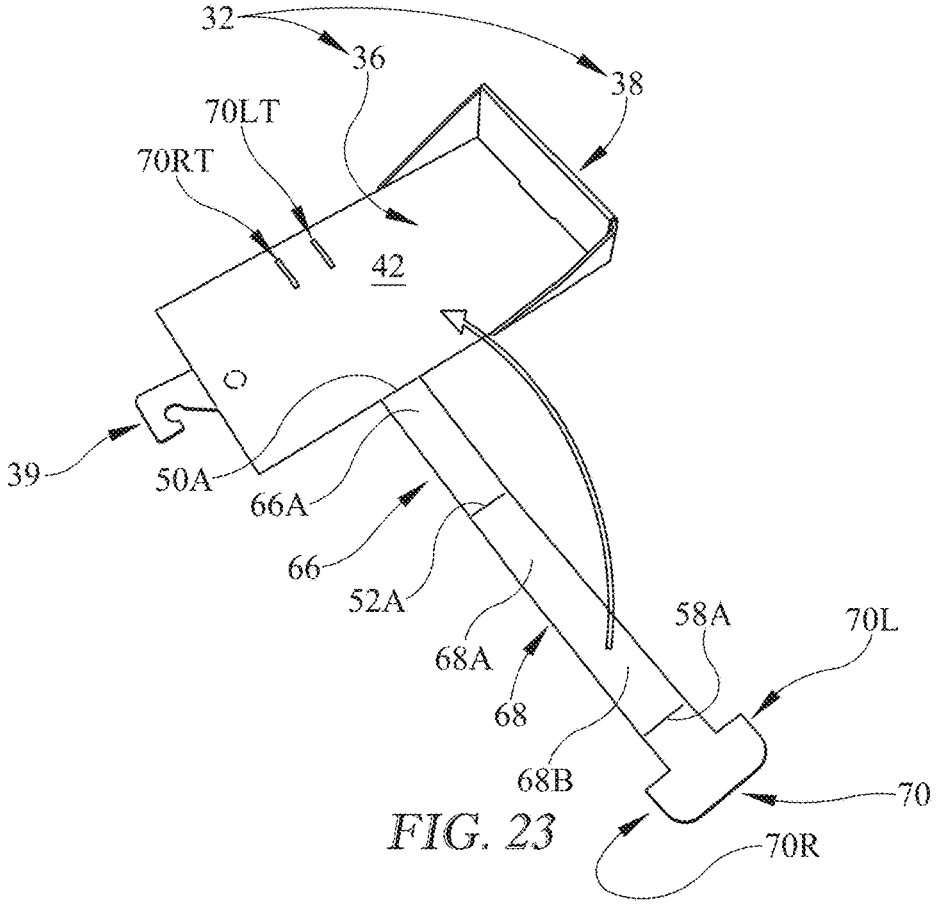
Figure 24:
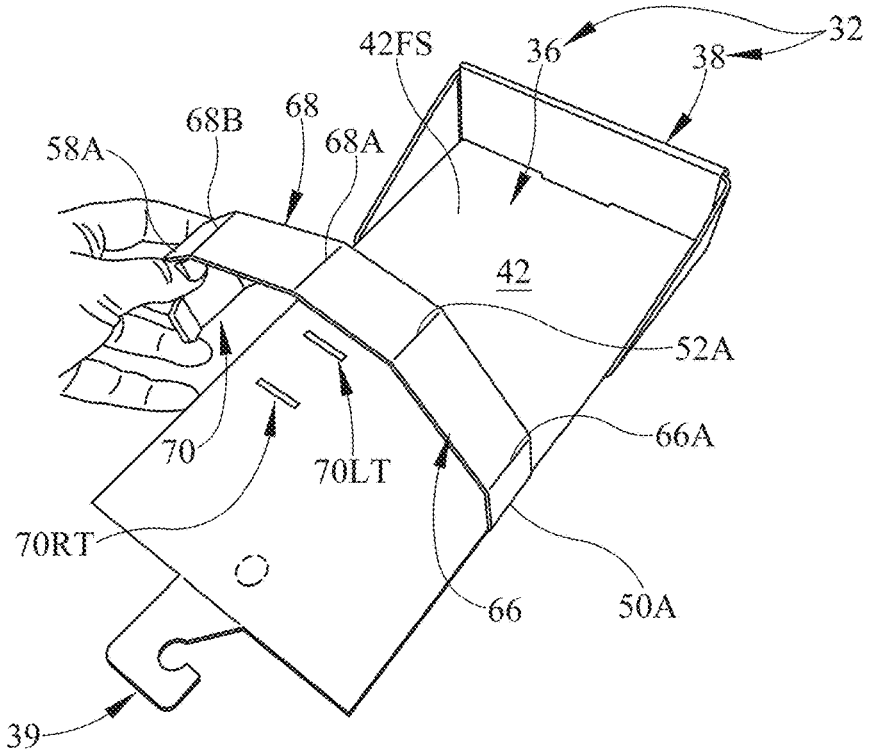
Figure 25:
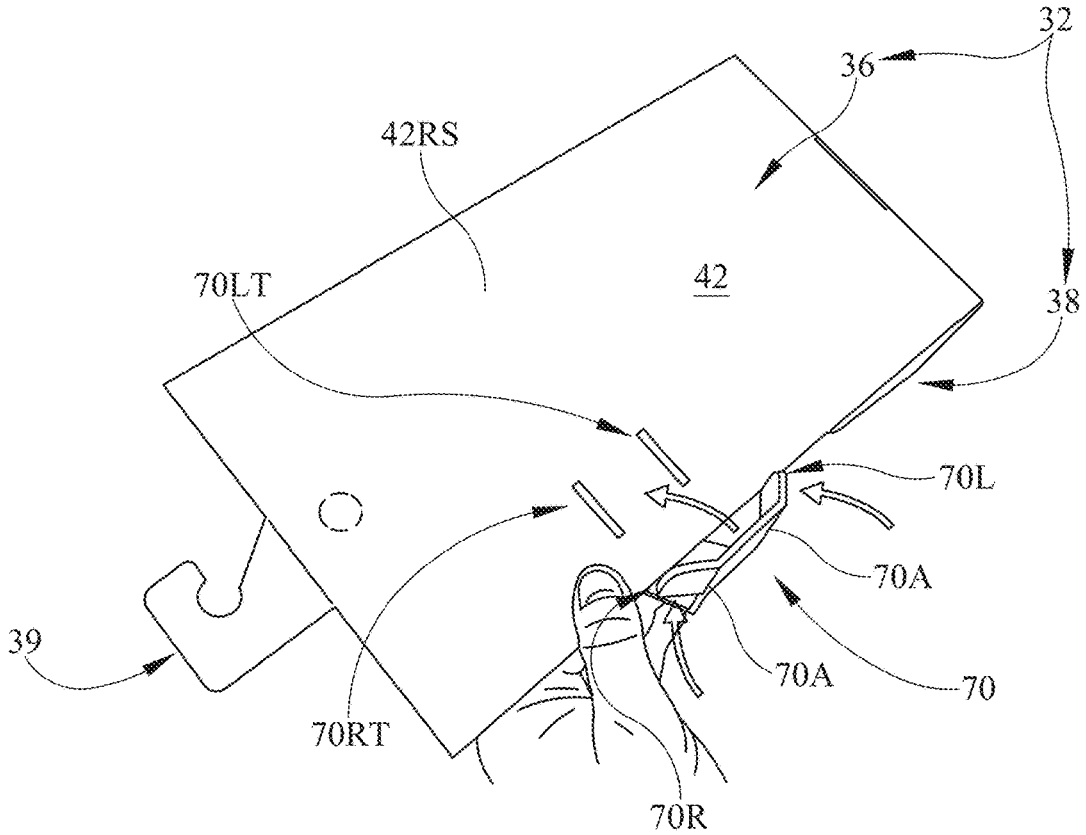
Figure 26:
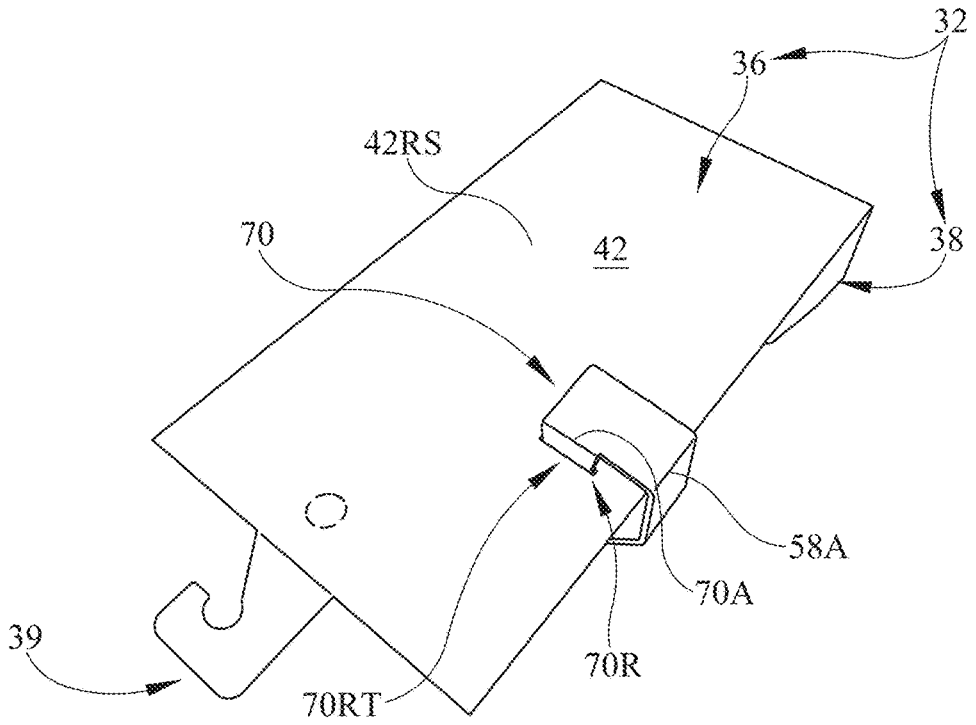
Figure 27:
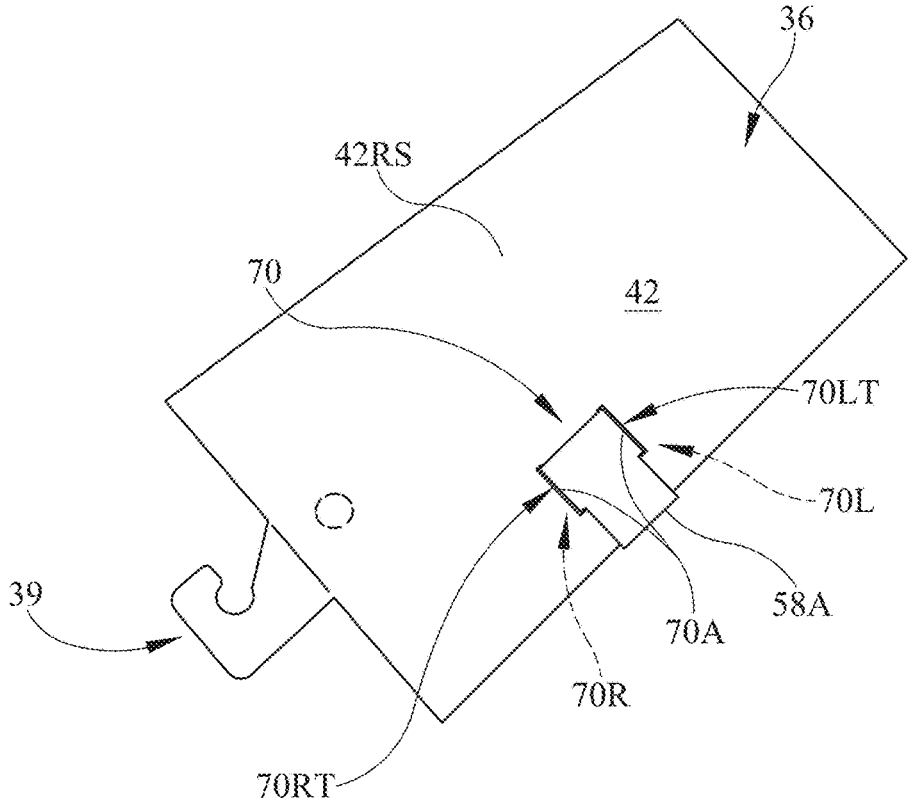
Figure 28:
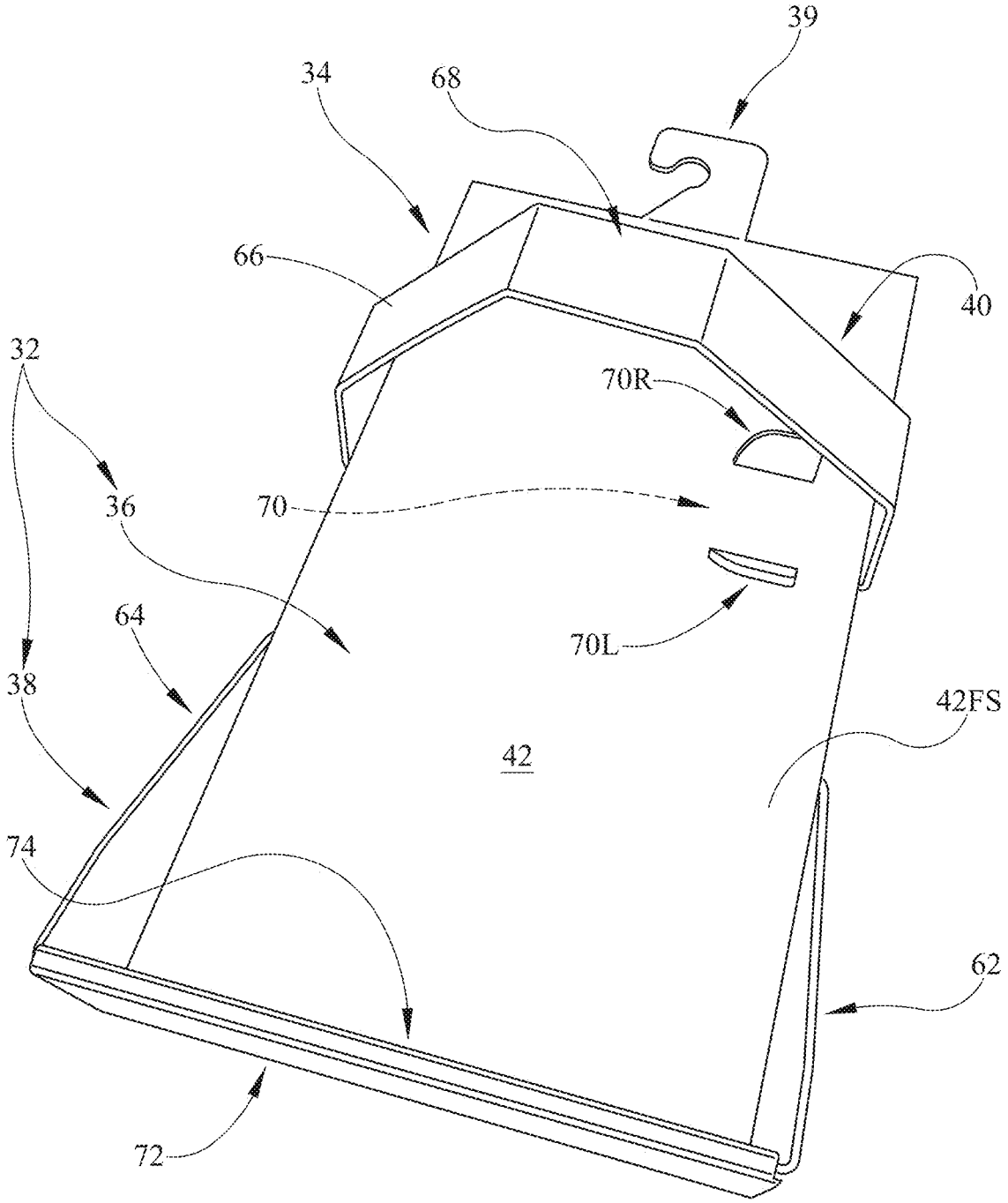

FIG. 9 is a perspective view of the partially folded shipping-mode blank of FIG. 8 being folded further to erect the rear container wall of the product-display container and showing the folding movement of the left and right rear anchor flaps included on the rear container wall about a fold line relative to the front container wall and folding movement of the front container wall relative to the bottom panel so that the container anchor tabs on each of the left and right container walls may be inserted into respective tab receivers on the left and right rear anchor flaps;

FIG. 10 is a view similar to FIG. 9 showing the container anchor tabs on each of the left and right container walls has been inserted into respective tab receivers on the left and right rear anchor flaps to hold the rear container wall in the upright position relative to the bottom panel so as to form the shipping-container body of the product-shipping container;

FIG. 11 is a perspective view of the partially folded shipping-mode blank of FIG. 10 being folded to erect the front lid wall and the left and right lid walls of the product-shipping container and showing the folding movement of the left and right lid anchor flaps included on the front lid wall about a fold line relative to the front lid wall;

FIG. 12 is a view similar to FIG. 11 showing the folding movement of the left and right lid walls along a fold line relative to the front lid wall so that lid anchor tabs on each of the left and right lid walls may be inserted into tab receivers on the left and right lid anchor flaps to couple the left and right lid walls to the front led wall;

FIG. 13 is a view similar to FIG. 12 showing the lid anchor tabs on each of the left and right lid walls being inserted into respective tab receivers on the left and right lid anchor flaps to couple the left and right lid walls to the front lid wall;

FIG. 14 is a view similar to FIG. 13 showing the container anchor tabs on each of the left and right lid walls has been inserted into respective tab receivers on the left and right lid anchor flaps to hold the front, left, and right lid walls an upright position relative to the lid panel so as to form the lid of the product-shipping container;

FIG. 15 is a perspective view of the shipping-mode blank fully folded to form the product-shipping container with the lid in the opened position in which the lid is spaced apart from the top opening to grant access to the product-receiving space;

FIG. 16 is a view similar to FIG. 15 showing the lid has been moved to the closed position in which the lid covers a top opening of the shipping-container body to block access to the product-receiving space;

FIG. 17 is an elevation view of the unfolded shipping-mode blank of FIG. 3 showing the discardable portion has been separated from the main portion to provide the display-mode blank prior to forming the product-display container, and further showing the display-mode blank includes the bottom panel, the left container wall, a portion of the right container wall, a portion of the front container wall, a portion of the rear container wall, a portion of the lid panel, and a portion of the front lid wall of the original shipping-mode blank;

FIG. 18 is perspective view of the display-mode blank of FIG. 17 being folded to erect a bottom support wall of the product-display container and showing the folding movement of the folding movement of the left container wall and the portions of the front and rear container walls about respective fold lines relative to the bottom panel;

FIG. 19 is a view similar to FIG. 18 showing the folding movement of the left container wall about an intermediate fold line so that an anchor tab on the left container wall may be inserted into a tab receiver formed along the fold line between the bottom panel and the left container wall;

FIG. 20 is a view similar to FIG. 19 showing the left container wall being folded along the intermediate fold line;

FIG. 21 is a rear view of the display-mode blank of FIG. 20 showing the left container wall being folded along the intermediate fold line so that the anchor tab moves toward being inserted in the tab receiver formed along the fold line between the bottom panel and the left container wall;

FIG. 22 is a view similar to FIG. 20 showing the left container wall has been folded along the intermediate fold line so that the anchor tab on the left container wall is inserted into the tab receiver formed along the fold line between the bottom panel and the left container wall to form the bottom support wall of the product-display container;

FIG. 23 is a rear view of the display-mode blank of FIG. 22 showing the folding movement of the portion of the rear container wall, the portion of the lid panel, and the portion of the front lid wall along the respective fold lines relative to the bottom panel to begin forming the strap of the product-display container;

FIG. 24 is a view similar to FIG. 23 showing the portion of the rear container wall, the portion of the lid panel, and the portion of the front lid wall have been folded along the respective fold lines relative to the bottom panel so that strap anchor tabs may be aligned with strap tab receivers formed in the bottom panel;

FIG. 25 is a rear view of the display-mode blank of FIG. 24 showing that folding movement of the strap anchor tabs so that the strap anchor tabs may be each inserted in the respective strap tab receiver in the bottom panel;

FIG. 26 is a view similar to FIG. 25 showing the strap anchor tabs being inserted into the respective strap tab receiver in the bottom panel on a rear side of the bottom panel;

FIG. 27 is a view similar to FIG. 26 showing the strap anchor tabs inserted into the respective strap tab receiver in the bottom panel so as to form the strap of the product-display container; and FIG. 28 is front view of the product-display container of FIG. 27 showing the strap extends around the back panel of the product-display container so as to retain a product located in the product-receiving display space.

DETAILED DESCRIPTION

Figure 1:
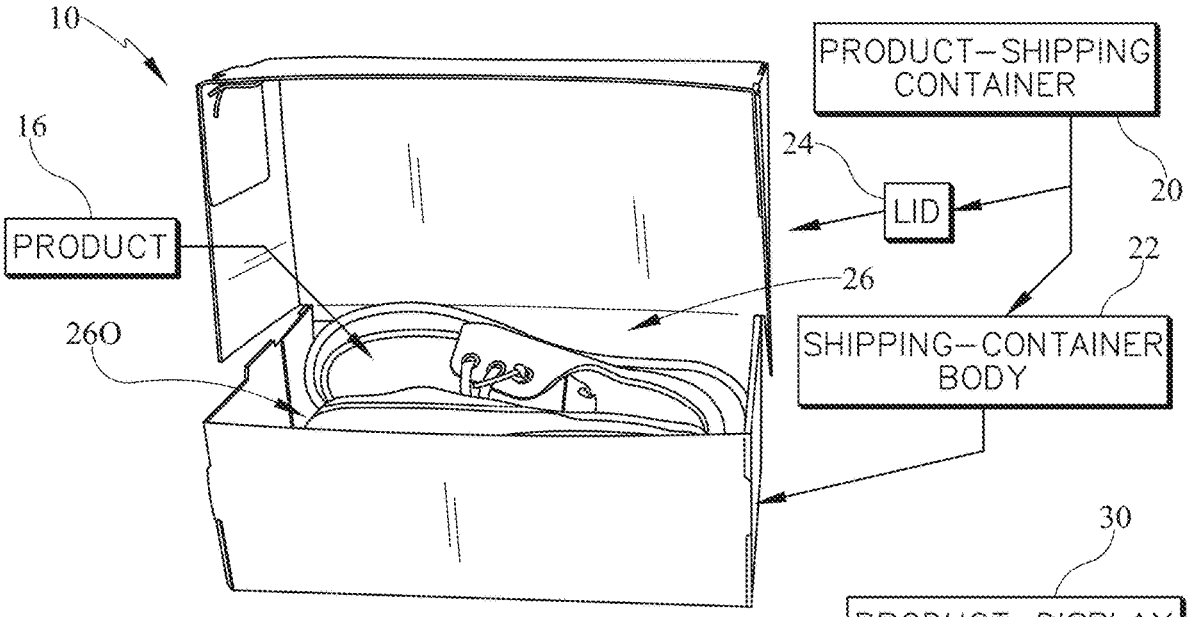
Figure 2:
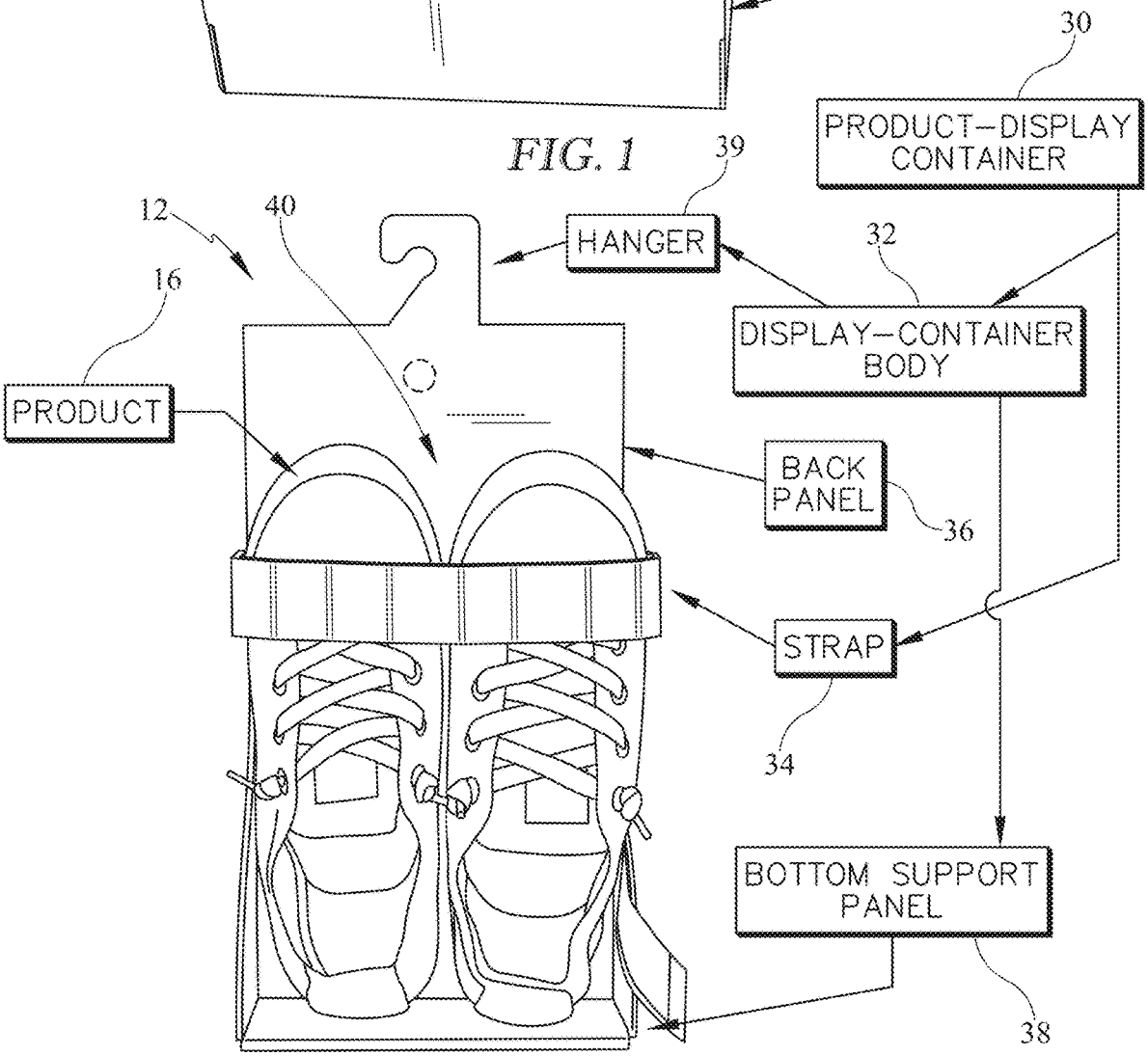

An illustrative shipping mode-blank 10 is shown in FIG. 3. The shipping-mode blank 10 is configured to be folded into a product-shipping container 20 as shown in FIG. 1 and a product-display container 30 as shown in FIG. 2. The shipping-mode blank 10 includes a central portion 12 and a discardable portion 14 that is configured to be separated from the central portion 12 along perforated tear lines to produce the display-mode blank 12 before the display-mode blank 12 is folded into the product-display container 30.

The two-in-one configuration allows two different containers 20, 30 to be formed using a single blank 10. The product-shipping container 20 may be formed to package a product 16 for shipment. Once received, the product-shipping container 20 may be unfolded and the display-mode blank 12 produced from the unfolded shipping-mode blank 10 so that the product-display container 30 may be formed.

Unlike the product-shipping container 20, the product-display container 30 is configured to better display the product 16 to potential customers.

The shipping-mode blank 10 is made of a paper material. In the illustrative embodiment, the shipping-mode blank 10 is made of a paperboard or cardboard material. In other embodiments, the shipping-mode blank 10 may be made of another suitable packaging material.

The product-shipping container 20 includes a shipping-container body 22 and a lid 24 as shown in FIG. 1. The shipping-container body 22 is formed to define a product-receiving space 26 that receives the product 16. The lid 24 is pivotably coupled to the shipping-container body 22 about a lid axis 52A to change between a closed position as shown in FIG. 16 and an opened position as shown in FIG. 15. In the closed position, the lid 24 blocks access to the product 16 in the product-receiving space 26. In the open position, the lid 24 is spaced apart from an opening of the product-receiving space to allow access to the product 16 in the product-receiving space 26.

The product-display container 30 includes a display-container body 32 and a strap 34 as shown in FIG. 2. The display-container body 32 is formed to define a back panel 36 and a bottom support panel 38 that cooperate to define a product-receiving display space 40. The strap 34 is coupled to the back panel 36 of the display-container body 32. The strap 34 is configured to extend around the product 16 located in the product-receiving display space 40 to retain the product 16 in the product-receiving display space 40. In the illustrative embodiment, the display-container body 32 includes a hanger 39 configured to support the product-display container 30 on a display hook.

The shipping-mode blank 10 includes the center portion 12 and the discardable portion 14 as shown in FIG. 13. The discardable portion 14 gets removed from the center portion 12 to produce the display-mode blank 12 so that the display-mode blank 12 may be folded into the product-display container 30.

The shipping-mode blank 10 includes a bottom panel 42, left, right, front, and rear container walls 44, 46, 48, 50, a lid panel 52, and left, right, and front lid walls 54, 56, 58 as shown in FIG. 3. The left, right, front, and rear container walls 44, 46, 48, 50 are coupled to the bottom panel 42 along fold lines 44A, 46A, 48A, 50A. The left, right, and front lid walls 54, 56, 58 are coupled to the lid panel 52 along fold lines 54A, 56A, 58A. The left, right, front, and rear container walls 44, 46, 48, 50 get folded along corresponding fold lines 44A, 46A, 48A, 50A to form the shipping-container body 22 of the product-shipping container 20 as shown in FIGS. 5-10, while the left, right, and front lid walls 54, 56, 58 get folded along corresponding fold lines 54A, 56A, 58A to form the lid 24 of the product-shipping container 20 as shown in FIGS. 11-14.

The display-mode blank 12 includes the bottom panel 42, the left container wall 44, a portion 60 of the right container wall 46, a portion 62 of the front container wall 48, a portion 64, 66 of the rear container wall 50, a portion 68 of the lid panel 52, and a portion 70 of the front lid wall 58 of the original shipping-mode blank 10. The bottom panel 42 forms the back panel 36 of the display-container body 32. The left container wall 44, the portion 62 of the front container wall 48, and the portion 64 of the rear container wall 50 get folded along the corresponding fold lines to form the bottom support panel 38. The portion 60 of the right container wall 50 forms the hanger 39.

The left and right container walls 44, 46 each include a base wall 44W, 46W, front container anchor tabs 44F, 46F, and rear container anchor tabs 44R, 46R as shown in FIG. 3. The base wall 44W, 46W is coupled to the bottom panel 42 along the fold line 44A, 46A. The front and rear container anchor tabs 44F, 44R, 46F, 46R are coupled to the base wall 44W. 46W about a tab fold line 44B, 46B.

The left container wall 44 includes the base wall 44W, the left front container anchor tab 44F, and the left rear container anchor tab 44R as shown in FIG. 3. The base wall 44W is coupled to the bottom panel 42 along the fold line 44A. The left front container anchor tab 44F and the left rear container anchor tab 44R are coupled to the base wall 44W about tab fold lines 44B.

The right container wall 46 includes the base wall 46W, the right front container anchor tab 46F, and the right rear container anchor tab 46R as shown in FIG. 3. The base wall 46W is coupled to the bottom panel 42 along the fold line 46A. The right front container anchor tab 46F and the right rear container anchor tab 46R are coupled to the base wall 46W about tab fold lines 46B.

The front and rear container walls 48, 50 each include a base wall 48W, 50W, left container anchor flaps 48L, 50L, and right container anchor flaps 48R, 50R as shown in FIG. 3. The base wall 48W, 50W is coupled to the bottom panel 42 along the fold line 48A, 50A. The left and right container anchor flaps 48L, 50L are coupled to the base wall 48W, 50W about a flap fold line 48B, 50B.

The front container wall 48 includes the base wall 48W, the left front container anchor flap 48L, and the right front container anchor flap 48R as shown in FIG. 3. The base wall 48W is coupled to the bottom panel 42 along the fold line 48A. The left front container anchor flap 48L and the right front container anchor flap 48R are coupled to the base wall 48W along a flap fold line 48B.

The front container wall 48 is also shaped to define front anchor tab receivers 44FT, 46FT as shown in FIG. 3. The left front anchor tab receiver 44FT is configured to receive the left front container anchor tab 44F. The right front anchor tab receiver 46FT is configured to receive the right front container anchor tab 46F.

The rear container wall 50 includes the base wall 50W, the left rear container anchor flap 50L, and the right rear container anchor flap 50R as shown in FIG. 3. The base wall 50W is coupled to the bottom panel 42 along the fold line 50A. The left rear container anchor flap 50L and the right rear container anchor flap 50R are coupled to the base wall 50W along a flap fold line 50B.

The rear container wall 50 is also shaped to define rear anchor tab receivers 44RT, 46RT as shown in FIG. 3. The left rear anchor tab receiver 44RT is configured to receive the left rear container anchor tab 44R. The right rear anchor tab receiver 46RT is configured to receive the right rear container anchor tab 46R.

Each of the front and rear container anchor tabs 44F, 44R, 46F, 46R has a bendable portion 44FB, 44RB, 46FB, 46RB that are configured to be bent along fold line 44C, 46C relative to the rest of the respective container anchor tab 44F, 44R, 46F, 46R as shown in FIG. 3. The front and rear container anchor tabs 44F, 44R, 46F, 46R are configured to bent along fold line 44C, 46C so that each may be inserted into the respective anchor tab receiver 44FT, 44RT, 46FT, 46RT. Each of the anchor tab receivers 44FT, 44RT, 46FT, 46RT has a portion that is angled relative to the fold line 48B, 50B it is formed in as shown in FIG. 3.

The left and right lid walls 54, 56 each include a base wall 54W, 56W and lid anchor tabs 54F, 56F as shown in FIG. 3. The base wall 54W, 56W is coupled to the lid panel 52 along the fold line 54A, 56A. The lid anchor tabs 54F, 56F are coupled to the base wall 54W, 56W about a tab fold line 54B, 56B.

The left lid wall 54 includes the base wall 54W and the left lid anchor tab 54F as shown in FIG. 3. The base wall 54W is coupled to the lid panel 52 along the fold line 54A. The left lid anchor tabs 54F is coupled to the base wall 54W about a tab fold line 54B.

The right lid wall 56 includes the base wall 56W and the right lid anchor tab 56F as shown in FIG. 3. The base wall 56W is coupled to the lid panel 52 along the fold line 56A. The right lid anchor tab 56F is coupled to the base wall 56W about a tab fold line 56B.

The front lid wall 58 includes the base wall 58W, the left lid anchor flap 58L, and the right lid anchor flap 58R as shown in FIG. 3. The base wall 58W is coupled to the lid panel 52 along the fold line 58A. The left lid anchor flap 58L and the right lid anchor flap 58R are coupled to the base wall 58W along a flap fold line 58B.

The front lid wall 58 is also shaped to define lid anchor tab receivers 54FT, 56FT as shown in FIG. 3. The left lid anchor tab receiver 54FT is configured to receive the left lid anchor tab 54F. The right lid anchor tab receiver 56FT is configured to receive the right lid anchor tab 56F.

Each of the lid anchor tabs 54F, 56F has a bendable portion 54FB, 5654 that are configured to be bent along fold line 54C, 56C relative to the rest of the respective lid anchor tab 54F, 56F as shown in FIG. 3. The lid anchor tabs 54F, 56F are configured to bent along fold line 54C, 56C so that each may be inserted into the respective anchor tab receiver 54FT, 56FT. Each of the anchor tab receivers 54FT, 56FT has a portion that is angled relative to the fold line 58B it is formed in as shown in FIG. 3.

Figure 5:
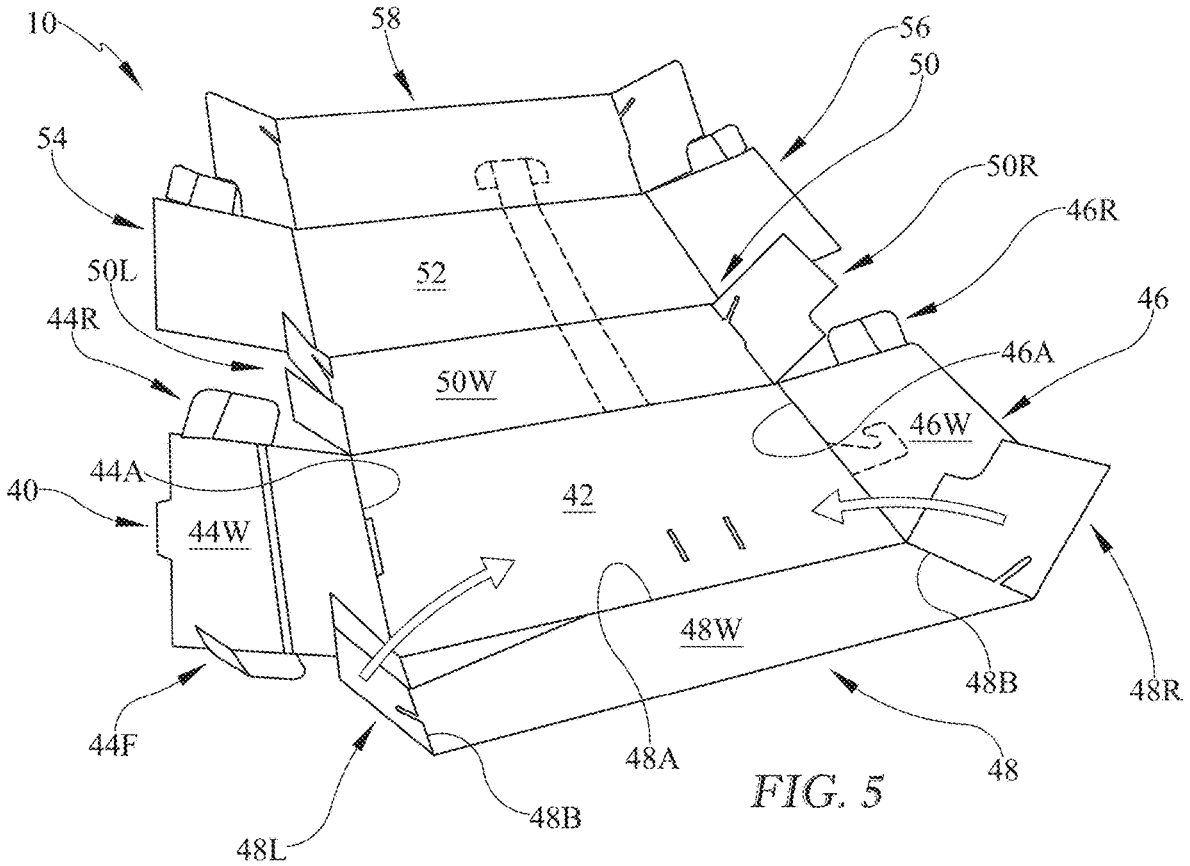
FIG. 5 is perspective view of the shipping-mode blank of FIG. 3 being folded to erect the front container wall and the left and right container walls of the product-shipping container and showing the folding movement of the left and right front anchor flaps included on the front container wall about a fold line relative to the front container wall.
Figure 6:
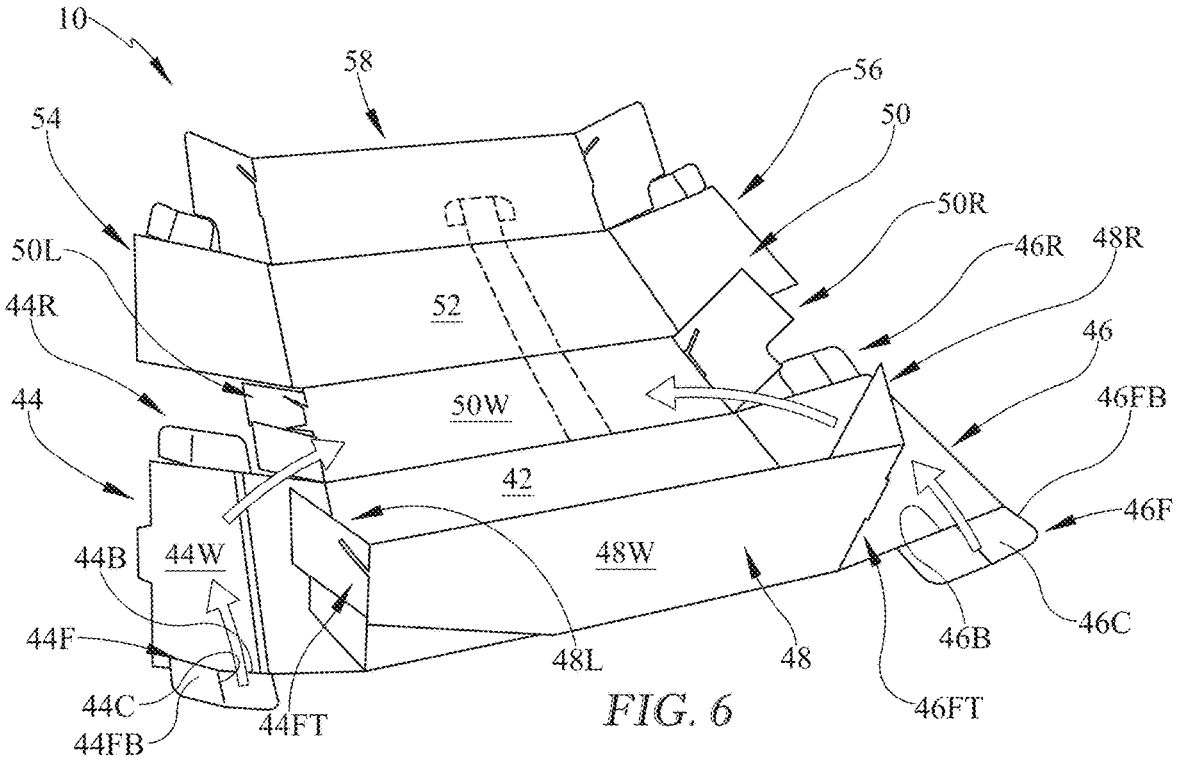
FIG. 6 is a view similar to FIG. 5 showing the folding movement of the left and right container walls along a fold line relative to the front container wall so that container anchor tabs on each of the left and right container walls may be inserted into tab receivers on the left and right front anchor flaps to couple the left and right container walls to the front container wall.

To begin folding the shipping-container body 22, the base wall 48W of the front container wall 48 is folded along fold line 48A relative to the bottom panel 42 as shown in FIGS. 5 and 6. Next, the base wall 44W of the left container wall 44 is folded along fold line 44A and the base wall 46 of the right container wall 46 is folded along fold line 46A as shown in FIGS. 6 and 7.

The front container anchor flaps 48L, 48R are folded along fold lines 48B relative to the base wall 48W of the front container wall 48 as shown in FIGS. 5 and 6. Similarly, the front container anchor tabs 44F, 46F, are folded along fold lines 44B, 46B as shown in FIGS. 6 and 7. In this way, the front container anchor tabs 44F, 46F align with the front anchor tab receivers 44FT, 46FT formed in the left and right front container anchor flaps 48L, 48R as shown in FIG. 7.

Figure 7:
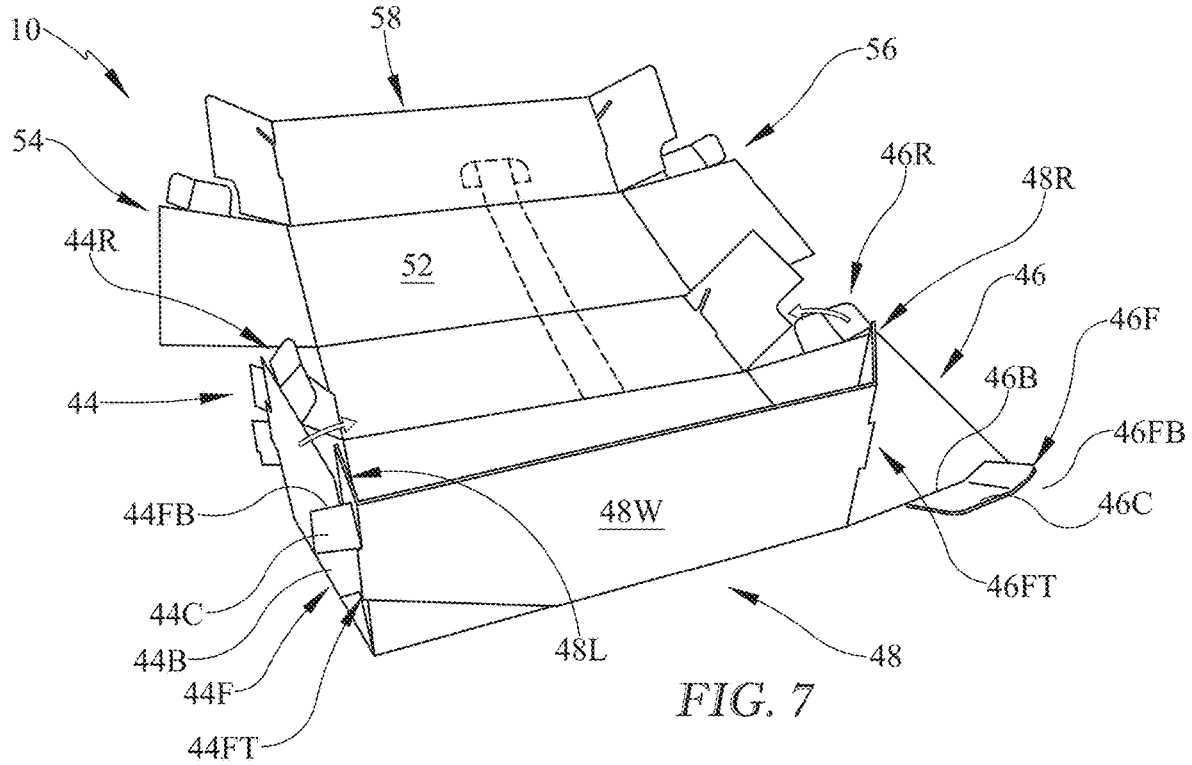
FIG. 7 is a view similar to FIG. 6 showing the container anchor tabs on each of the left and right container walls being inserted into respective tab receivers on the left and right front anchor flaps to couple the left and right container walls to the front container wall.

The left front container anchor tab 44F is inserted into the left front anchor tab receiver 44FT in the left front container anchor flap 48L and the right front container anchor tab 46F is inserted into the right front anchor tab receiver 46FT in the right front container anchor flap 48R as shown in FIGS. 7 and 8. By inserting the front container anchor tabs 44F, 46F into the corresponding anchor tab receivers 44FT, 46FT, the left, right, and front container walls 44, 46, 48 are held in an upright position relative to the bottom panel 42 as shown in FIG. 8.

Next, the base wall 50W of the rear container wall 50 is folded along fold line 50A relative to the bottom panel 42 as shown in FIG. 9. At the same time, the left and right container anchor flaps 50L, 50R are folded along the fold lines 50B so that the rear container anchor tabs 44R, 46R may be inserted into left and right rear anchor tab receivers 44RT, 46RT as shown in FIGS. 9 and 10. By inserting the rear container anchor tabs 44R, 46R into the corresponding anchor tab receivers 44RT, 46RT, the rear container wall 50 is held in the upright position relative to the bottom panel 42 along with the left, right, and front container walls 44, 46, 48 as shown in FIG. 10.

In the illustrative embodiment, the front container wall 48 is erected into the upright position before the rear container wall 50 as shown in FIGS. 5-10. In some embodiments, the rear container wall 50 may be erected into the upright position before the front container wall 48.

The lid 24 may be formed by folding the base wall 58W of the front lid wall 58 along the fold line 58A relative to the lid panel 52 as shown in FIGS. 11 and 12. At the same time, the left and right lid anchor flaps 58L, 58R are folded along the fold lines 58B so that the lid anchor tabs 54F, 56F may be inserted into left and right anchor tab receivers 54FT, 56FT as shown in FIGS. 11 and 12. By inserting the lid anchor tabs 54F, 56F into the corresponding anchor tab receivers 54FT, 56FT, the left, right, and front lid walls 54, 56, 58 are held in the upright position relative to the bottom panel 52 as shown in FIG. 14.

In the illustrative embodiment, the shipping-container body 22 is formed before the lid 24 as shown in FIGS. 11-14. In some embodiments, the lid 24 may be formed before the shipping-container body 22.

Once formed, the lid 24 may be moved from the open position as shown in FIG. 15 to the closed position as shown in FIG. 16. To move the lid 24 to the closed position, the lid panel 52 of the lid 24 is folded along the fold line 52A, also referred to as the lid axis 52A, so that the lid 24 covers a top opening 260 of the shipping-container body 22 to block access to the product-receiving space 26. To open the product-shipping container 20, the lid 24 is pivoted about the lid axis 52A.

To form the product-display container 30, the shipping-mode blank 10 is first unfolded and the discardable portion 14 separated from the central portion 12 to form the display-mode blank 12. The discardable portion 14 is separated from the central portion 12 along perforated tear lines 18A-E.

In the illustrative embodiment, some of the perforated tear lines 18A-G are the same as the fold lines 46A, 48A, 50A. The perforated line 18A is part of the fold line 46A. The perforated line 18B is part of the fold line 48A. The perforated lines 18C, 18D are part of the fold line 50A. In the illustrative embodiment, the perforated lines 18F, 18G are the tab fold lines 44B.

The display-mode blank 12 includes the bottom panel 42, the left container wall 44, the portion 60 of the right container wall 46, the portion 62 of the front container wall 48, the portions 64, 66 of the rear container wall 50, the portion 68 of the lid panel 52, and the portion 70 of the front lid wall 58 of the original shipping-mode blank 10. The portion 62 of the front container wall 48 is coupled to the bottom panel 42 along the fold line 48A. The portions 64, 66 of the rear container wall 50 are coupled to the bottom panel 42 along the fold line 50A.

The portion 62 of the front container wall 48 includes part of the base wall 48W and part of the left front container anchor flap 48L. The part of the left front container anchor flap 48L is coupled to the part of the base wall 48W along fold line 48B.

Similarly, the portion 64 of the rear container wall 50 includes part of the base wall 50W and part of the left rear container anchor flap 50L. The part of the left rear container anchor flap 50L is coupled to the part of the base wall 50W along fold line 50B.

The portion 66 of the rear container wall 50 is spaced apart from the other portion 62 of the rear container wall 50. The portion 66 of the rear container wall 50 coupled to the bottom panel 42 along the fold line 50A. The portion 68 of the lid panel 52 is coupled to the portion 66 of the rear container wall 50 along the fold line 52A. The portion 70 of the front lid wall 58 is coupled to the portion 68 of the lid panel 52 along the fold line 58A.

The base wall 44W of the left container wall 44 includes a first section 72, a second section 74, and a base wall anchor tab 76 as shown in FIG. 3. The second section is coupled to the first section 72 along an intermediate fold line 74A. The base wall anchor tab 76 extends from the section 74. The second section 74 is configured to be folded about the intermediate fold line 74A relative to the first section 72 so that the base wall anchor tab 76 may be inserted into the anchor tab receiver 76T formed along the fold line 44A between the bottom panel 42 and the left container wall 44.

The portion 70 of the front lid wall 58 forms a terminal end of the strap 34 as shown in FIG. 3. The portion 70 includes strap anchor tabs 70L, 70R as shown in FIG. 3. The strap anchor tabs 70L, 70R are coupled to the portion 70 along fold lines 70A.

To begin folding the display-container body 32, the part of the left front container anchor flap 48L is folded along the fold line 48B relative to the part of the base wall 48W as shown in FIGS. 18 and 19. Similarly, the part of the left rear container anchor flap 50L is folded along the fold line 50B relative to the part of the base wall 50W as shown in FIGS. 18 and 19. Then, the part of the base wall 48W is folded along the fold line 48A relative to the bottom panel 42 and the part of the base wall 50W is folded along the fold line 50A so that the portions 62, 64 are in the upright position relative to the bottom panel 42 as shown in FIGS. 18 and 19.

While holding the portions 62, 64 in the upright position, the left container wall 44 is folded along the fold line 44A relative to the bottom panel 42 as shown in FIGS. 18 and 19. Once folded, the first section 72 of the left container wall 44 is parallel with the part of the left front container anchor flap 48L and the part of the left rear container anchor flap 50L as shown in FIG. 19-21.

Next, the section 74 of the left container wall 44 is folded about the intermediate fold line 74A relative to the first section 72 as shown in FIGS. 20 and 21. The second section 74 of the left container wall 44 is folded about the intermediate fold line 74A to begin inserting the base wall anchor tab 76 with the anchor tab receiver 76T as shown in FIGS. 20 and 21.

The second section 74 of the left container wall 44 is folded about the intermediate fold line 74A so that the second section 74 is parallel with the first section 72 as shown in FIGS. 22 and 23. The part of the left front container anchor flap 48L and the part of the left rear container anchor flap 50L are trapped between the first section 72 and the second section 74 of the base wall 44W of the left container wall 44 after the second section 74 is folded and the base wall anchor tab 76 inserted into the anchor tab receiver 76T.

Next, the strap 34 is folded relative to the bottom panel 42 as shown in FIGS. 23-25. The portion 66 of the rear container wall 50 is folded along the fold line 50A to begin attaching the strap 34. The portion 66 may be folded along intermediate fold lines 66A in order to bend the strap 34 to the desired shape. The portion 68 is folded along the fold line 52A. The portion 68 may be folded along intermediate fold lines 68A, 68B in order to bend the strap 34 to the desired shape. Finally, the portion 70 is folded along the fold line 58A. The portions 66, 68, 70 relative to the bottom panel 42 so that the portion 70 extends around to the rear side 42RS of the bottom panel 42 as shown in FIGS. 24 and 25.

Next, the strap anchor tabs 70L, 70R are folded along the fold lines 70A relative the portion 70 as shown in FIG. 25. The strap anchor tabs 70L, 70R are folded along the fold lines 70A so that the strap anchor tabs 70L. 70R may be inserted into the strap anchor tab receivers 70LT, 70RT formed in the bottom panel 42 as shown in FIGS. 26 and 27. The strap anchor tabs 70L, 70R extend through the rear side 42RS of the bottom panel 42 into the strap anchor tab receivers 70LT. 70RT. In the illustrative embodiment, the strap anchor tabs 70L, 70R extend through the rear side 42RS and poke out a front side 42FS of the bottom panel 42 as shown in FIG. 28.

By inserting the strap anchor tabs 70L, 70R into the respective strap anchor tab receivers 70LT, 70RT, the free end of the strap 34 is coupled to the display-container body 32. The strap 34 extends around the product 16 located in the product-receiving display space 40 to retain the product 16 in the product-receiving display space 40.

Figure 4:
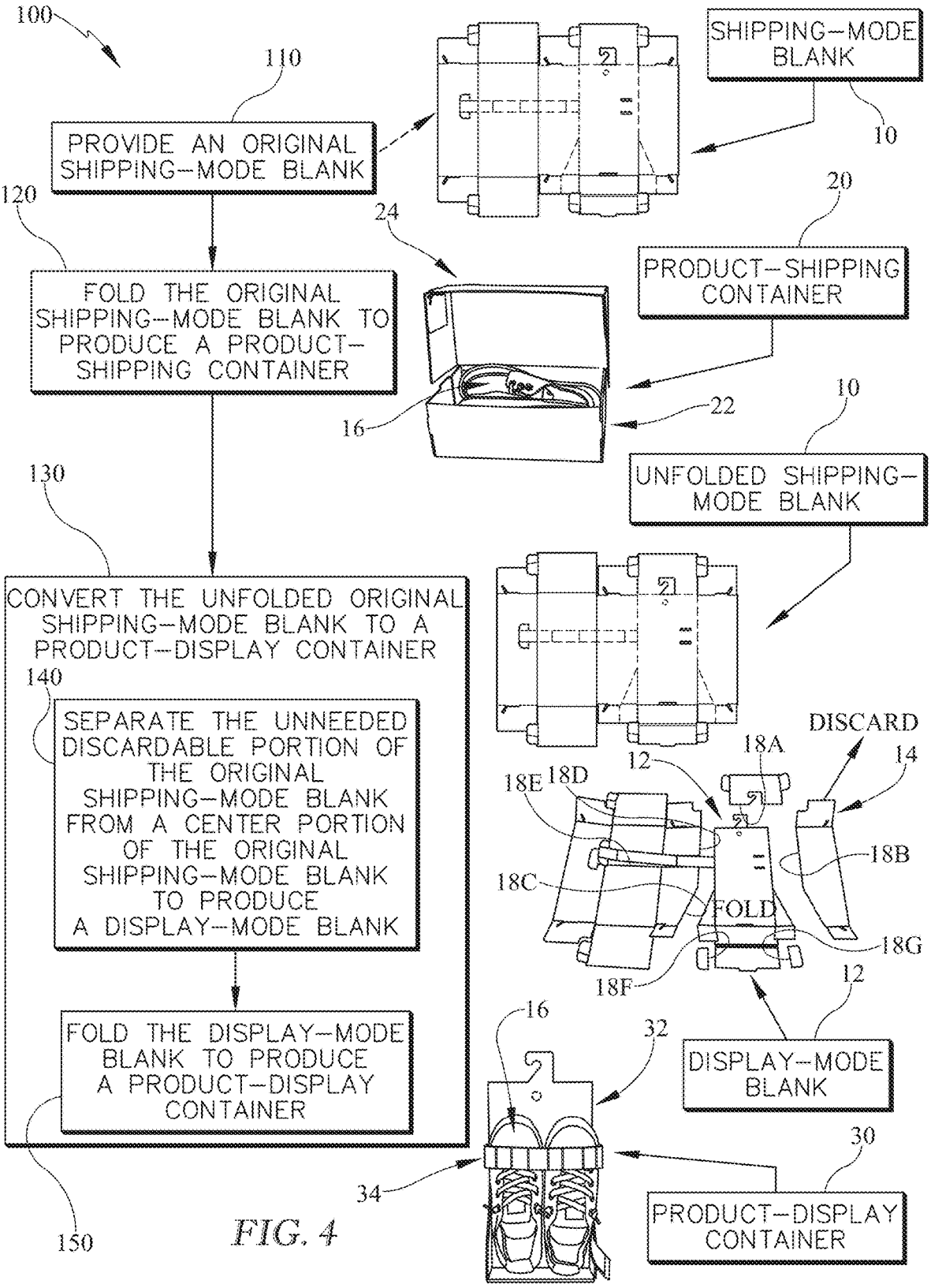

A method of using the shipping-mode blank 10 is shown in FIG. 4. The method includes first folding the shipping-mode blank 10 to produce the product-shipping container 20. To fold the shipping-mode blank 10 into the product-shipping container 20, the method may include pre-folding the shipping-mode blank 10 along the respective fold lines so that it may be easier to assemble the product-shipping container 20. Pre-folding the shipping-mode blank 10 may include bending the shipping-mode blank along the respective fold lines.

To fold the shipping-mode blank 10 to produce the product-shipping container 20, the method includes folding the left, right, front, and rear container walls 44, 46, 48, 50 along the respective fold lines 44A-C, 46A-C, 48A-B, 50A-B relative to the bottom panel 42 to form the shipping-container body 22 of the product-shipping container 20. This step may also include folding the left, right, and front lid walls 54, 56, 58 along the respective fold lines 54A-C. 56A-C, 58A-B relative to the lid panel 52 to form the lid 24 of the product-shipping container 20.

Next, the product 16 may be inserted into the product-receiving space 26 of the product-shipping container 20. In the illustrative embodiment, the product 16 is a pair of shoes. The pair of shoes may any type of shoe, e.g. sneakers, sandals, or any other suitable footwear. In other embodiments, the product 16 may be another product type.

To display the product 16, the method includes removing the product 16 from the product-shipping container 20 before unfolding the shipping-mode blank 10. Next, the method includes separating the discardable portion 14 of the shipping-mode blank 10 from the center portion 12 along the perforated lines 18A-G to produce the display-mode blank 12 as shown in FIG. 4.

Next, the display-mode blank 12 is folded to produce the product-display container 30. To fold the display-mode blank 12 to produce the product-display container 30, the method includes folding the left container wall 44 and the portions of the front and rear container walls 48, 50 along the respective fold lines 44A, 48A, 50A, 74A relative to the bottom panel 42 to form the display-container body 32 of the product-display container 30. This step may also include folding the portion of the rear container wall 50, the portion of the lid panel 52, and the portion of the front lid wall 58 along the respective fold lines 50A, 66A, 68A-B, 70A relative to the bottom panel 42 to from the strap 34 of the product-display container 30 as shown in FIG. 4.

Once the product-display container 30 is formed, the method include inserting the product 16 into the product-receiving display space 40. Next, the product-display container 30 with the product 16 inserted therein may be hung on a display hook using the hanger 39. In some embodiments, the product-display container 30 includes a hole 41 as suggested in FIG. 3 that may be used to hang the product-display container 30.

The invention claimed is:

1. A method comprising providing a shipping mode blank comprising a center portion and a discardable portion configured to be separated from the center portion, folding the shipping-mode blank to produce a product-shipping container including a shipping-container body formed to define a product-receiving shipping space and a lid pivotably coupled to the shipping-container body about a lid axis to change between a closed position in which the lid covers a top opening of the shipping-container body to block access to the product-receiving shipping space and an opened position in which the lid is spaced apart from the top opening, unfolding the shipping-mode blank, separating the discardable portion of the shipping-mode blank from the center portion along a perforated line to produce a display-mode blank, and folding the display-mode blank to produce a product-display container including a display-container body formed to define a product-receiving display space and a strap coupled to the display-container body and configured to extend around a product located in the product-receiving display space to retain the product in the product-receiving display space.

2. The method of claim 1, wherein the shipping mode blank includes a bottom panel, left, right, front, and rear container walls each coupled to the bottom panel along a respective fold line, a lid panel coupled to the rear container wall along a lid fold line, and left, right, and front lid walls each coupled to the lip panel along a respective fold line, and wherein folding the shipping-mode blank to produce the product-shipping container includes (i) folding the left, right, front, and rear container walls along the respective fold lines relative to the bottom panel to form the shipping-container body of the product-shipping container and (ii) folding the left, right, and front lid walls along the respective fold lines relative to the lid panel to form the lid of the product-shipping container.

3. The method of claim 2, wherein folding the shipping-mode blank to produce the product-shipping container further includes folding the lid panel along the lid fold line.

4. The method of claim 2, wherein the display-mode blank includes the bottom panel, the left container wall, a portion of the right, front, and rear container walls, a portion of the lid panel, and a portion of the front lid wall.

5. The method of claim 4, wherein folding the display-mode blank to produce the product-display container includes (i) folding the left container wall and the portions of the front and rear container walls along the respective fold lines relative to the bottom panel to form the display-container body of the product-display container and (ii) folding the portion of the rear container wall, the portion of the lid panel, and the portion of the front lid wall along the respective fold lines relative to the bottom panel to from the strap of the product-display container.

6. The method of claim 4, wherein the bottom panel, the left container wall, a portion of the right, front, and rear container walls forms the display-container body of the product-display container and a portion of the rear container wall, a portion of the lid panel, and a portion of the front lid wall forms the strap of the product-display container.

7. The method of claim 2, wherein the method further includes hanging the product-display container on a display hook after folding the display-mode blank to produce the product-display container.

8. The method of claim 7, wherein the product-display container further includes a hanger coupled to the display-container body and configured to support the product-display container on the display hook, and wherein the portion of the right container wall forms the hanger of the product-display container.

9. The method of claim 1, wherein the shipping-mode blank includes a bottom panel, left, right, front, and rear container walls each coupled to the bottom panel along a respective fold line, a lid panel coupled to the rear container wall along a lid fold line, and left, right, and front lid walls each coupled to the lip panel along a respective fold line, and wherein the display-mode blank includes the bottom panel, the left container wall, a portion of the right container wall, a portion of the front container wall, a portion of the rear container wall, a portion of the lid panel, and a portion of the front lid wall.

10. The method of claim 9, wherein folding the shipping-mode blank to produce the product-shipping container includes (i) folding the left, right, front, and rear container walls along the respective fold lines relative to the bottom panel to form the shipping-container body of the product-shipping container and (ii) folding the left, right, and front lid walls along the respective fold lines relative to the lid panel to form the lid of the product-shipping container.

11. The method of claim 10, wherein folding the shipping-mode blank to produce the product-shipping container further includes folding the lid panel along the lid fold line.

12. The method of claim 9, wherein the folding the display-mode blank to produce the product-display container includes (i) folding the left container wall and the portions of the front and rear container walls along the respective fold lines relative to the bottom panel to form the display-container body of the product-display container and (ii) folding the portion of the rear container wall, the portion of the lid panel, and the portion of the front lid wall along the respective fold lines relative to the bottom panel to from the strap of the product-display container.

13. The method of claim 1, wherein the method further includes hanging the product-display container on a display hook after folding the display-mode blank to produce the product-display container.

14. The method of claim 13, wherein the product-display container further includes a hanger coupled to the display-container body and hanging the product-display container on the display hook includes engaging the hanger of the product-display container with the display hook.

15. A convertible package comprising a shipping mode blank configured to be folded to form a product-shipping container including a shipping-container body formed to define a product-receiving shipping space and a lid pivotably coupled to the shipping-container body about a lid axis to change between a closed position in which the lid covers a top opening of the shipping-container body to block access to the product-receiving shipping space and an opened position in which the lid is spaced apart from the top opening, wherein the shipping mode blank includes a center portion and a discardable portion configured to be separated from the center portion to produce a display-mode blank configured to folded to form a product-display container including a display-container body formed to define a product-receiving display space and a strap coupled to the display-container body and configured to extend around a product located in the product-receiving display space to retain the product in the product-receiving display space.

16. The package of claim 15, wherein the shipping mode blank includes a bottom panel, left, right, front, and rear container walls each coupled to the bottom panel along a respective fold line, a lid panel coupled to the rear container wall along a lid fold line, and left, right, and front lid walls each coupled to the lip panel along a respective fold line.

17. The package of claim 16, wherein the bottom panel and the left, right, front, and rear container walls are configured to be folded to form the shipping-container body of the product-shipping container and the lid panel and the left, right, and front lid walls are configured to be folded to form the lid of the product-shipping container.

18. The package of claim 15, wherein the display-mode blank includes the bottom panel, the left container wall, a portion of the right, front, and rear container walls, a portion of the lid panel, and a portion of the front lid wall.

19. The package of claim 18, wherein the bottom panel, the left container wall, and the portions of the front and rear shipping-container are configured to be folded to form the display-container body of the product-display container and the portion of the rear container wall, the portion of the lid panel, and the portion of the front lid wall are configured to be folded to from the strap of the product-display container.

20. The package of claim 15, wherein the product-display container further includes a hanger coupled to the display-container body and the hanger configured to support the product-display container on a display hook.

* * * * *